US010500433B2

(12) United States Patent
Fairchild et al.

(10) Patent No.: US 10,500,433 B2
(45) Date of Patent: Dec. 10, 2019

(54) WORKOUT DEVICES AND METHODS

(71) Applicant: 1930109 ONTARIO INC., Sudbury (CA)

(72) Inventors: Jamie Fairchild, Sudbury (CA); Mark Simmons, Toronto (CA)

(73) Assignee: 1930109 ONTARIO INC., Sudbury (CA)

( * ) Notice: Subject to any disclaimer, the term of this patent is extended or adjusted under 35 U.S.C. 154(b) by 0 days.

(21) Appl. No.: 15/434,833

(22) Filed: Feb. 16, 2017

(65) Prior Publication Data

US 2017/0239508 A1 Aug. 24, 2017

Related U.S. Application Data

(60) Provisional application No. 62/297,650, filed on Feb. 19, 2016.

(51) Int. Cl.

| | |
|---|---|
| ***A63B 21/065*** | (2006.01) |
| ***A63B 7/02*** | (2006.01) |
| ***A63B 24/00*** | (2006.01) |
| ***A63B 7/00*** | (2006.01) |
| ***A63B 21/00*** | (2006.01) |
| ***A63B 21/16*** | (2006.01) |
| ***A63B 22/16*** | (2006.01) |
| ***A63B 23/02*** | (2006.01) |

(Continued)

(52) U.S. Cl.

CPC ..... *A63B 21/065* (2013.01); *A63B 7/00* (2013.01); *A63B 7/02* (2013.01); *A63B 21/0005* (2013.01); *A63B 21/00047* (2013.01); *A63B 21/0616* (2015.10); *A63B 21/16* (2013.01); *A63B 21/4013* (2015.10); *A63B 22/16* (2013.01); *A63B 23/0211* (2013.01); *A63B 23/0216* (2013.01); *A63B 23/0405* (2013.01); *A63B 23/1218* (2013.01); *A63B 23/1236* (2013.01); *A63B 24/0062* (2013.01); *A63B 21/0602* (2013.01); *A63B 21/0604* (2013.01); *A63B 21/068* (2013.01); *A63B 21/072* (2013.01); *A63B 21/169* (2015.10); *A63B 2023/0411* (2013.01); *A63B 2208/0295* (2013.01); *A63B 2225/09* (2013.01); *A63B 2225/50* (2013.01)

(58) Field of Classification Search

None

See application file for complete search history.

(56) References Cited

U.S. PATENT DOCUMENTS 4,770,414 A * 9/1988 Fredrickson ..... A63B 23/0211 482/148

4,953,857 A * 9/1990 Lemire ..... A63B 21/078 482/104

(Continued)

OTHER PUBLICATIONS

TRX Training. Printed May 24, 2017. "TRX Pro 4." https://www.trxtraining.com/products/trx-pro.

(Continued)

*Primary Examiner* — Stephen R Crow

(74) *Attorney, Agent, or Firm* — Norton Rose Fulbright Canada LLP

(57) ABSTRACT

A workout device that has an arcuate body having first and second ends, and one or more attachment points extending through the body, each attachment point for releasably attaching a load and for releasably attaching an anchor to suspend the workout device.

14 Claims, 46 Drawing Sheets

(51) Int. Cl.

| | |
|---|---|
| ***A63B 23/04*** | (2006.01) |
| ***A63B 23/12*** | (2006.01) |
| ***A63B 21/06*** | (2006.01) |
| *A63B 21/068* | (2006.01) |
| *A63B 21/072* | (2006.01) |

(56) References Cited

U.S. PATENT DOCUMENTS 5,248,287 A * 9/1993 Nicoletti ..... A63B 21/0618 482/106
5,254,063 A * 10/1993 House, Jr. ..... A63B 21/0728 403/104
5,267,931 A * 12/1993 Faetini ..... A61H 1/0296 128/DIG. 23
5,312,314 A * 5/1994 Stephan ..... A63B 21/0602 482/106
6,450,928 B1 * 9/2002 Larkins, Jr. ..... A63B 21/0608 482/106
6,485,400 B1 * 11/2002 Serlachius ..... A63B 23/0211 482/142
9,895,570 B2 * 2/2018 Shah ..... A61H 1/0274
2008/0200316 A1 * 8/2008 Shillington ..... A63B 21/0728 482/106
2010/0323852 A1 * 12/2010 Locsin ..... A63B 1/00 482/96
2015/0151154 A1 * 6/2015 Muhammad ..... A63B 21/063 482/99

OTHER PUBLICATIONS

Lifeline. Printed May 24, 2017. "Jungle Gym XT." https://www.lifelinefitness.com/store/products/ProductDetail.php?ProductID=683.
Rogue Fitness. Printed May 24, 2017. "Rogue Gymnastic Wood Rings." http://www.roguefitness.com/rogue-wood-rings.
Monkii. Printed May 24, 2017. "Shop monkii bars 2." https://monkii.co/shop/.
Vimeo. Printed May 24, 2017. "Gimme Kraft! proudly presents the »Matros Master«" https://vimeo.com/119576885.
American Barbell. Printed May 24, 2017. "Bars" https://americanbarbell.com/collections/bars.
IronMind . Printed May 24, 2017. "Buffalo Bar." http://www.ironmind-store.com/Buffalo-Bar153/productinfo/1270/.

* cited by examiner

WORKOUT DEVICES AND METHODS

CROSS-REFERENCE TO RELATED APPLICATIONS

This application claims priority from U.S. provisional patent application No. 62/297,650, filed Feb. 19, 2016, the entire contents of which are incorporated herein by reference.

FIELD

This relates to the field of workout devices, and in particular, to a multi-modal workout device with a plurality of attachment points for suspension-based training, bar-based weight training, and lower body weight training.

BACKGROUND

Regular physical exercise provides a myriad of benefits. For example, exercise can help prevent excess weight gain or help maintain weight loss. Exercise can also boost muscle strength, endurance, and energy levels. Regular exercise may also combat health conditions and disease, and can provide an emotional lift.

A balanced workout may include aerobic exercise, flexibility training, and strength training.

However, it may be difficult to exercise regularly for several reasons. One reason may be a lack of personal motivation to exercise. Second, there may be a lack of time to fit in regular exercise into a hectic schedule. Third, it may not be affordable or feasible to buy multiple pieces of gym equipment to perform various exercises for a balanced workout.

One way to exercise without purchasing multiple pieces of gym equipment is to use workout devices, especially versatile workout devices where one can perform multiple exercises with one device. Various workout devices have been developed for performing exercises. Unfortunately, existing workout devices tend not to be versatile, offer limited dimensionality in training, and may be difficult to use. In addition, some existing workout devices may not be used without an anchor. They may also not be used as a bar for bar-based weight training. Moreover, existing workout devices typically cannot be used as a lever, cannot be integrated with similar devices, and are not ergonomic.

SUMMARY

Disclosed herein is a workout device that has an arcuate body having first and second ends, and one or more attachment points extending through the body, each attachment point for releasably attaching a load and for releasably attaching an anchor to suspend the workout device.

Many further features and combinations thereof concerning embodiments described herein will appear to those skilled in the art following a reading of the instant disclosure.

BRIEF DESCRIPTION OF DRAWINGS

In the figures which illustrate example embodiments.

DETAILED DESCRIPTION

A multi-modal workout device and method for its use are disclosed. The workout device includes a plurality of internal attachment points to attach to one or more anchors and/or one or more loads. The workout device may be used to perform a plurality of exercises, such as suspension-based weight training, bar-based weight training, and lower body weight training for squatting, yoke walking, and lunging. The plurality of internal attachment points may enable a range of suspension geometries and hitching options for loading the workout device. The workout device may include hand holds and finger pockets that may provide a plurality of grip positions when using the workout device. Two workout devices may be connected in parallel to form a parallette for additional exercise options. Two or more workout devices may be connected in series for additional exercise options. The workout device may be equipped with Bluetooth capability and may include an embedded accelerometer and/or gyroscopic sensor to provide wireless biofeedback when the workout device is being used. The workout device may introduce multidimensional instability when exercising with the workout device.

Figure 1:
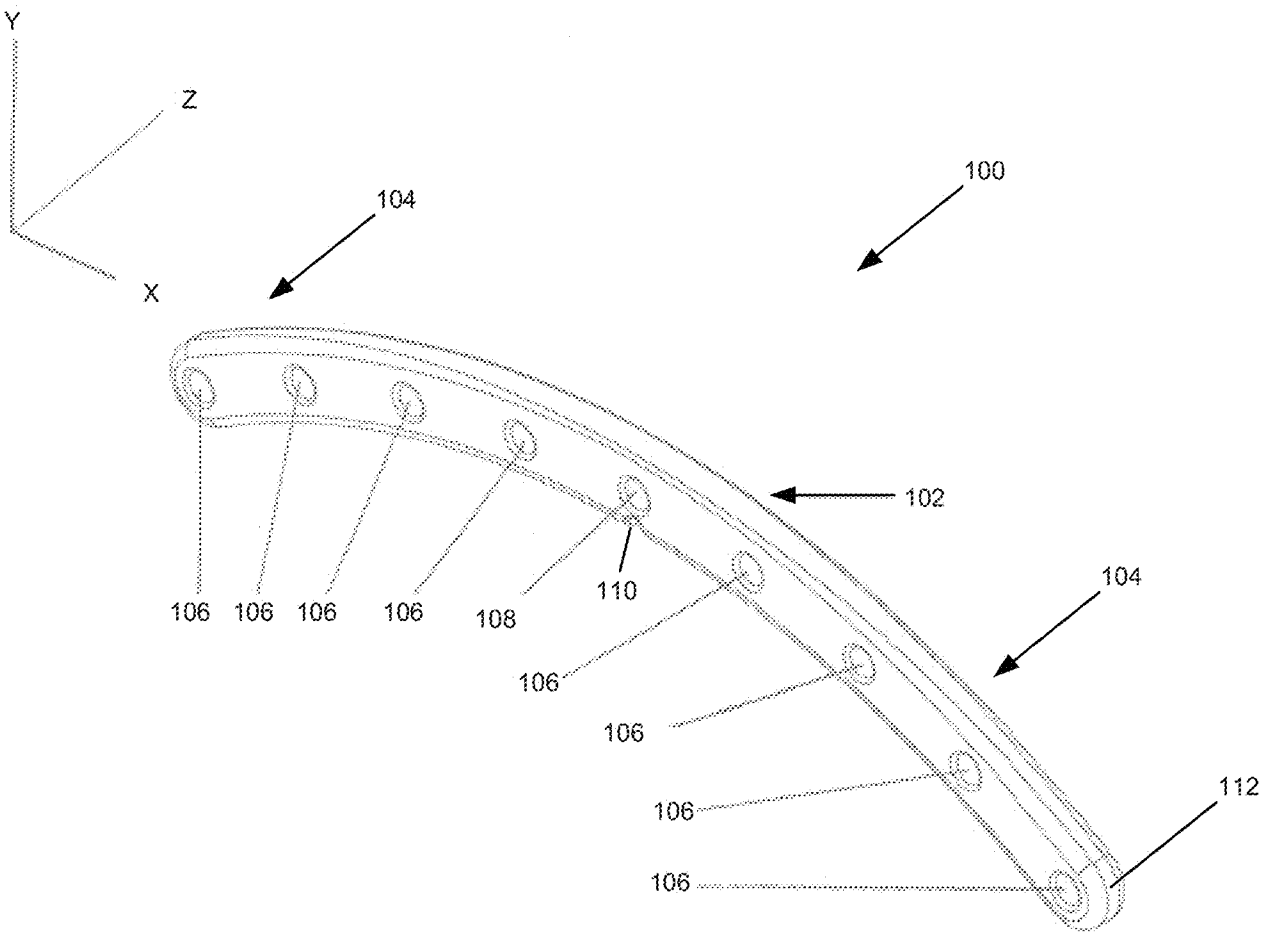
FIG. 1 is a perspective view of a workout device.

FIG. 1 is a perspective view of an example workout device 100, which may be used to perform a plurality of exercises.

Workout device 100 may include a body 102 and two limbs 104. As depicted, body 102 and limbs 104 are integrally formed and define a continuous arcuate shape. However, in other embodiments, body 102 and limbs 104 may be connected to one another using fasteners, welding or the like, and may define different shapes. Body 102 is generally the middle section of the workout device 100. Limbs 104 of workout device 100 are generally the sections terminal or distal from body 102. In some embodiments, body 102 may range in length from three inches to more than 72 inches, and limbs 104 may range in length from three inches to more than 24 inches.

Workout device 100 may include a plurality of attachment points 106 for attaching anchors and/or loads to workout device 100. Attachment points 106 may be channels extending through workout device 100 where external attachments devices and/or loads may be applied to, attached, or hitched to workout device 100. Attachment points 106 may be internal to workout device 100. Workout device 100 may include at least one attachment point 106. In some embodiments, the at least one attachment point 106 may be at the centre of workout device 100 such that when workout device 100 is suspended at a centre attachment point 108, workout device 100 may be in balanced suspension about centre attachment point 108.

Attachment points 106 may be sized to accommodate standard dowels, rods, and pegs. The edges of attachment points 106 may be bevelled, rounded, chamfered, or otherwise smoothed for comfortable holding, gripping, or securing of workout device 100 and for receiving dowels, rods, and pegs.

Appropriate attachment devices may be applied to, attached to, or hitched to workout device 100 at attachment points 106, such as a user's hands, wide-gait carabiners, climbing slings, cable, ropes, handles, chains, cam-buckle straps, elastic bands, rubber bands, and the like. A variety of appropriate loads may be attached to the appropriate attachment devices. The loads may include appropriate attachment devices to attach additional loads, buckets, loading pins, Olympic weights, standard weights, kettlebells, bags, bladders, cinder blocks, a user, any other appropriate object, or a combination thereof.

Attachment points 106 may be made of metal or rimmed with metal to increase strength and reduce wear and tear at the attachment points 106, such as when heavy loads are attached to attachment points 106.

As depicted in FIG. 1, workout device 100 comprises nine attachment points 106. The number of attachment points 106 and the distance between them may be determined by the size of workout device 100, ergonomic considerations, and required structural strength of workout device 100. In some embodiments, there may be 5 to 50 attachment points 106.

Workout device 100 may include a cervical notch 110. Cervical notch 110 may be located at the centre of workout device 100 on its inner arc, as depicted in FIG. 1. Cervical notch 100 may be a groove in workout device 100 for accommodating the cervical spine of a user who may be using workout device 100, which may reduce pressure applied on the cervical spine of the user from workout device 100 and may encourage the user to use workout device 100 ergonomically and encourage the user to practice proper form when exercising.

Workout device 100 may include edges 112. Edges 112 of workout device may be bevelled, rounded, chamfered, or otherwise smoothed for comfortable holding, gripping, or securing of workout device 100.

Figure 2:
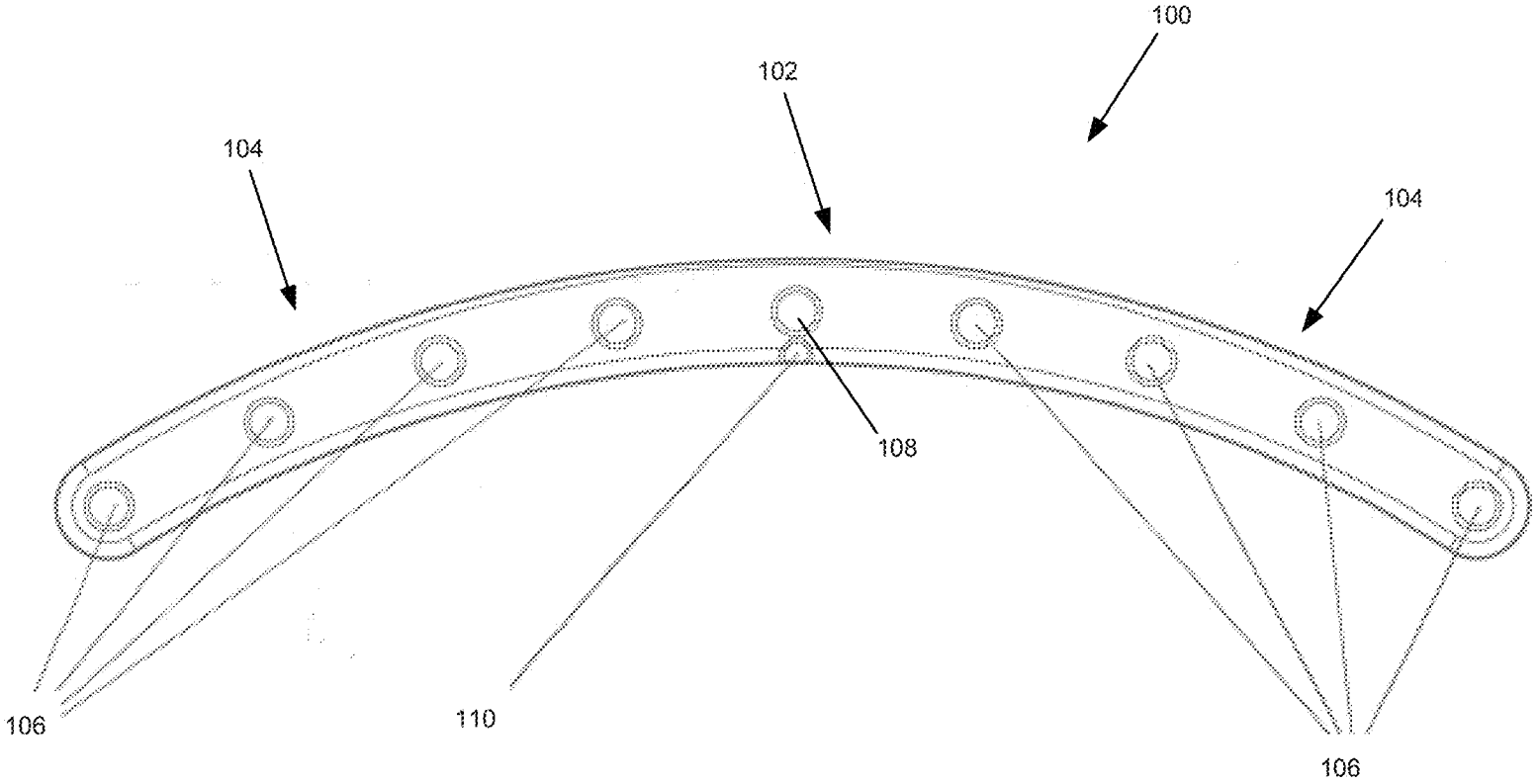
FIG. 2 is a front view of the workout device of FIG. 1.

FIG. 2 depicts a front view of workout device 100 showing the length of workout device 100. As depicted in FIG. 1 and FIG. 2, workout device 100 has an arced shape. In some embodiments, workout device 100 may have a straight shape. In some examples of its arced configuration, workout device 100 may range in length from 24 inches to 96 inches and define a radius of curvature between 19 inches and 31 feet. In some examples of its straight configuration, workout device 100 may range from 12 inches to 120 inches.

Figure 3:
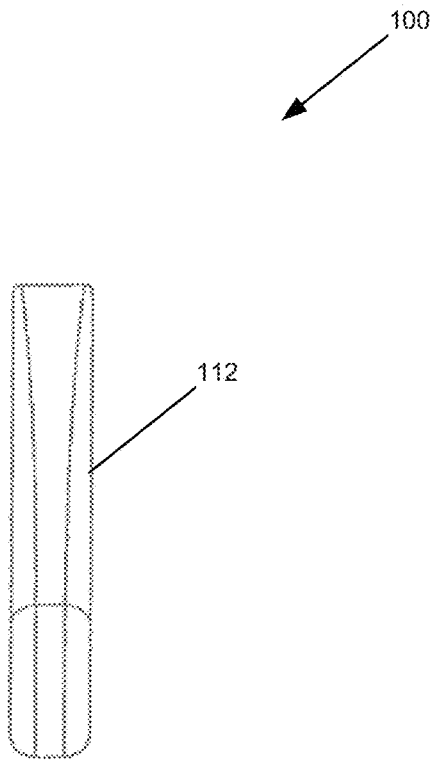
FIG. 3 is a side view of the workout device of FIG. 1.

FIG. 3 is a side view of workout device 100 showing a total height (i.e. when workout device 100 is placed on a flat surface with limbs 104 in contact with the flat surface, in the position shown in FIG. 1 through and FIG. 3, the total height being the vertical distance between the flat surface to the peak of workout device 100) of workout device 100. In some embodiments, workout device 100 may have a total height ranging from two inches to three feet. In some embodiments, workout device 100 may have a cross-sectional height (i.e. vertical thickness of workout device 100) ranging from two inches to 18 inches.

Figure 4:
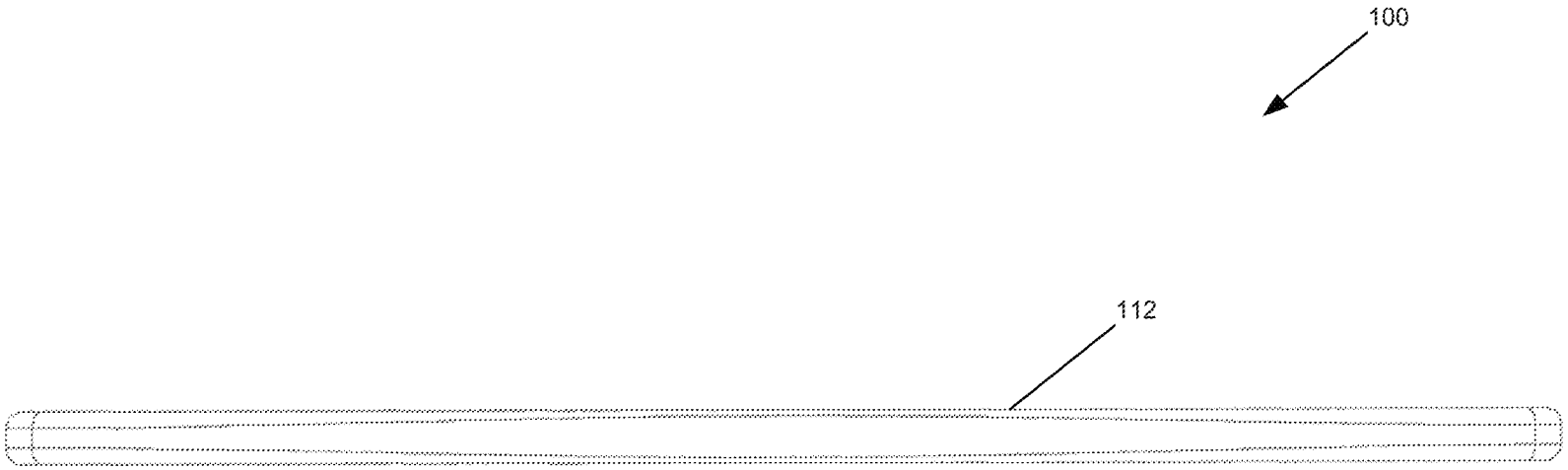
FIG. 4 is a top view of the workout device of FIG. 1.

FIG. 4 is a top view of workout device of FIG. 1 showing the thickness of workout device 100. In some embodiments, workout device 100 may have a thickness ranging from one inch to six inches.

In some embodiments, workout device 100 may be a solid, uniform, and fully integrated device where body 102 and limbs 104 are not able to be separated.

Workout device 100 may be manufactured using solid wood, laminated wood, metal, carbon fibre, plastic, organic and inorganic polymers, or a combination thereof.

When workout device 100 is manufactured with solid wood or laminated wood, workout device 100 may be manufactured by manual sawing, sanding, and drilling. In some embodiments, multiple sheets of plywood may be joined using the appropriate fastening devices, such as with glue and clamps. Computer numerical control may also be used to automate the product of workout device 100 from multiple sheets of joined plywood or a piece of solid wood with the appropriate dimensions.

Workout device 100 may also be manufactured with metal. Workout device 100 may be cast, forged, 3D-printed, or machined entirely from the appropriate metal, such as stainless steel (native or recycled), aluminum (native or recycled), nickel, titanium, zinc, and the like.

Workout device 100 may be manufactured with carbon fibre. A jig or form may be used to laminate uni-directional or bi-directional carbon fibre to manufacture workout device 100. Carbon fibre may be used on its own or may be used with wood and/or metal to manufacture workout device 100.

Workout device 100 may be manufactured with plastic and organic/inorganic polymers. Vacuum form technology or other appropriate methods may be used to manufacture workout device 100 with plastic and organic/inorganic polymers.

Figure 5:
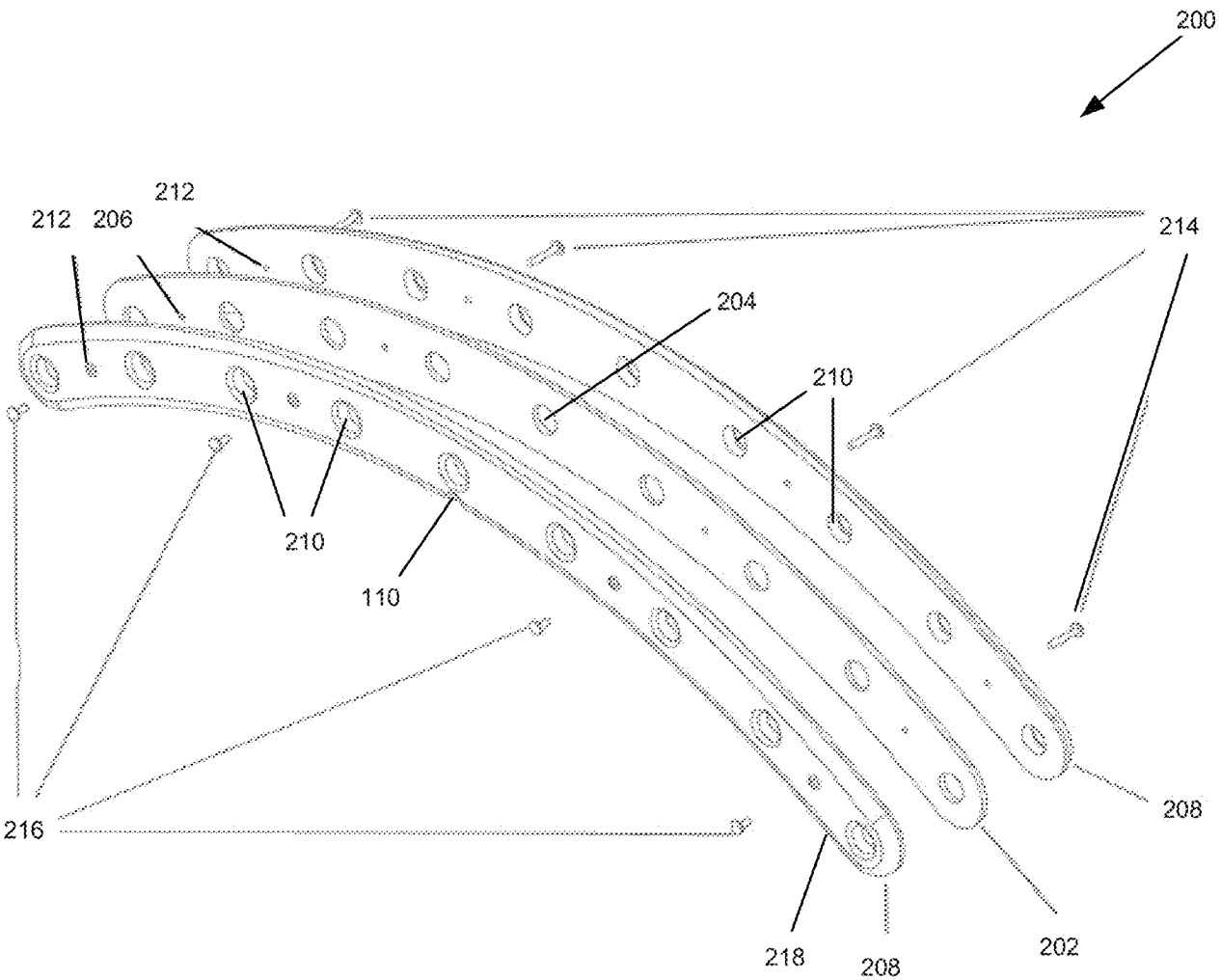
FIG. 5 is an exploded view of another workout device.

In some embodiments, workout device 100 may be manufactured with additional structural support. FIG. 5 depicts a workout device 200 with an internal support plate 202 and external frames 208. Internal support plate 202 may include plate attachment holes 204 and plate joining holes 206. External frames 208 may comprise frame attachment holes 210 and frame joining holes 212.

As depicted in FIG. 5, internal support plate 202 and external frames 208 are joined together with male rivets 214 and female rivets 216 through plate joining holes 206 and frame joining holes 212. Internal support plate 202 may be fastened to external frames 208 using other appropriate fastening devices, such as nuts and bolts, screws, adhesive compounds, or welding.

When internal support plate 202 is joined between external frames 208, plate attachment holes 204 of internal support plate 202 and frame attachment holes 210 of external frames 208 may define attachment points 106 on workout device 200.

Workout device 200 may include edges 218. Edges 218 of workout device may be bevelled, rounded, chamfered, or otherwise smoothed for comfortable holding, gripping, or securing of workout device 200.

Internal support plate 202 and external frames 208 may be manufactured using solid wood, laminated wood, metal, carbon fibre, plastic, organic/inorganic polymers, or a combination thereof. In some embodiments, internal support plate 202 is manufactured using metal, and external frames 208 are manufactured using solid wood or laminated wood.

Internal support plate 202 of workout device 200 may increase robustness and increase the amount of stress and strain that workout device 200 can experience without failure.

Figure 6:
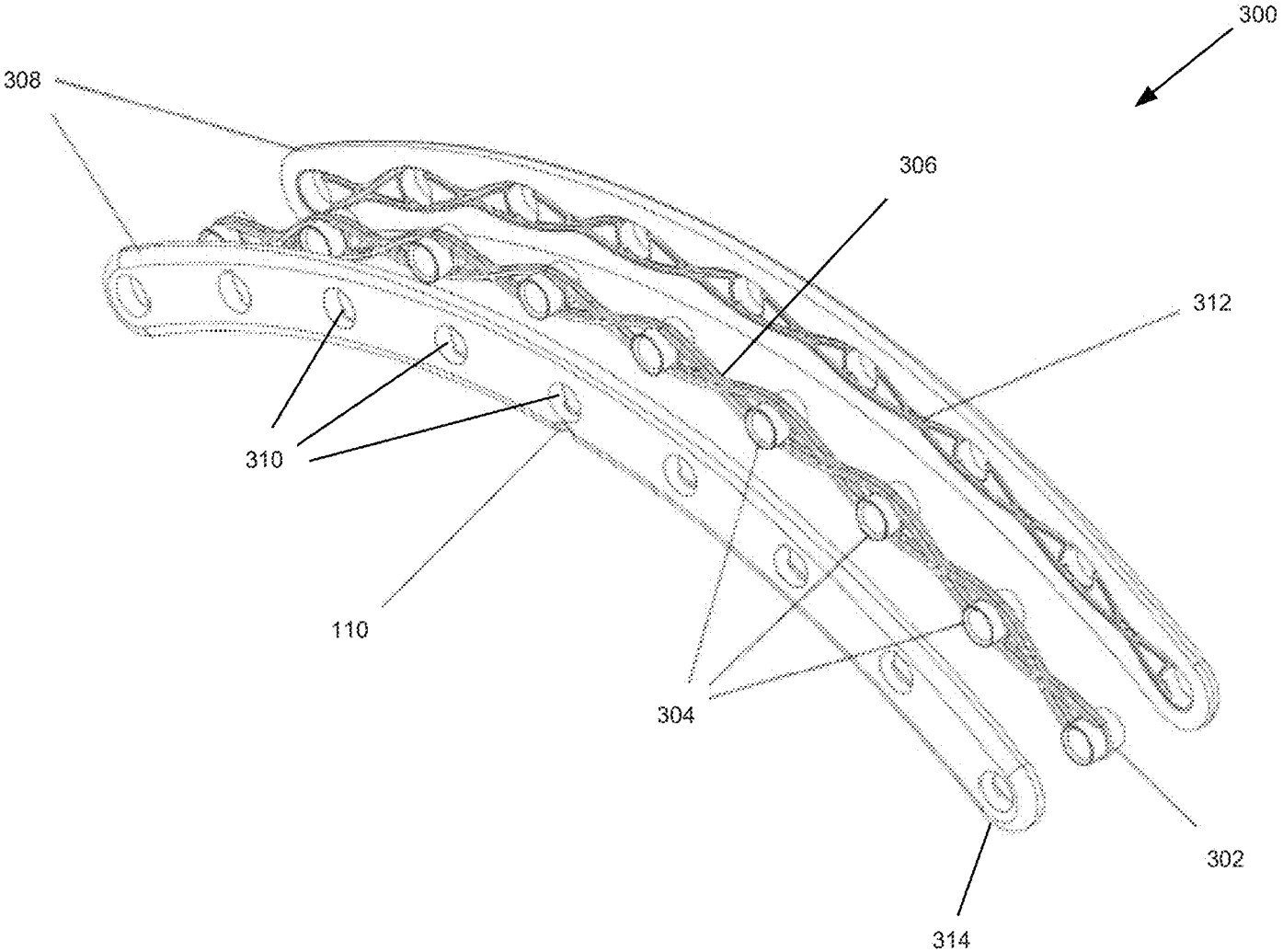
FIG. 6 is an exploded view of another workout device.

FIG. 6 depicts another workout device 300 with an internal support 302 and external frames 308. Internal support 302 may comprise internal attachment sleeves 304 and an internal skeleton 306, and external frames 308 may comprise frame attachment holes 310 and a skeleton inlay 312.

Skeleton inlay 312 may be shaped to fit internal attachment sleeves 304 and internal skeleton 306 of internal support 302 when internal support 302 is joined to external frames 308. Skeleton inlay 312 may be manufactured using computer numerical control such that internal support 302 and external frames 308 fit together when joined.

Internal support 302 and external frames 308 may be fastened together using appropriate fastening devices, such as nuts and bolts, rivets, adhesive compound, welding, and the like. Internal attachment sleeves 304 and frame attachment holes 310 may be manufactured and sized such that internal attachment sleeves 304 is in friction fit with frame attachment holes 310 to secure internal support 302 and external frames 308 together.

When internal support 302 is joined between external frames 308, internal attachment sleeves 304 of internal support 302 and frame attachment holes 310 of external frames 308 may define attachment points 106 on workout device 300.

Workout device 300 may include edges 314. Edges 314 of workout device may be bevelled, rounded, chamfered, or otherwise smoothed for comfortable holding, gripping, or securing of workout device 300.

Internal support 302 and external frames 308 may be manufactured using solid wood, laminated wood, metal, carbon fibre, plastic, organic/inorganic polymers, or a combination thereof. In some embodiments, internal support 302 is manufactured using metal, such as stainless steel (native or recycled), aluminum (native or recycled), nickel, titanium, and/or zinc, and external frames 308 are manufactured using solid wood or laminated wood.

As depicted, internal skeleton 306 has a structure that weaves around internal attachment sleeves 304 for increasing the amount of stress and strain that workout device 300 may experience without failure. Internal frame 302, internal attachment sleeves 304, and/or internal skeleton 306 may be designed and shaped in a manner to increase the amount of stress and strain that workout device 300 may experience without failure, such as a truss shape.

Figure 7:
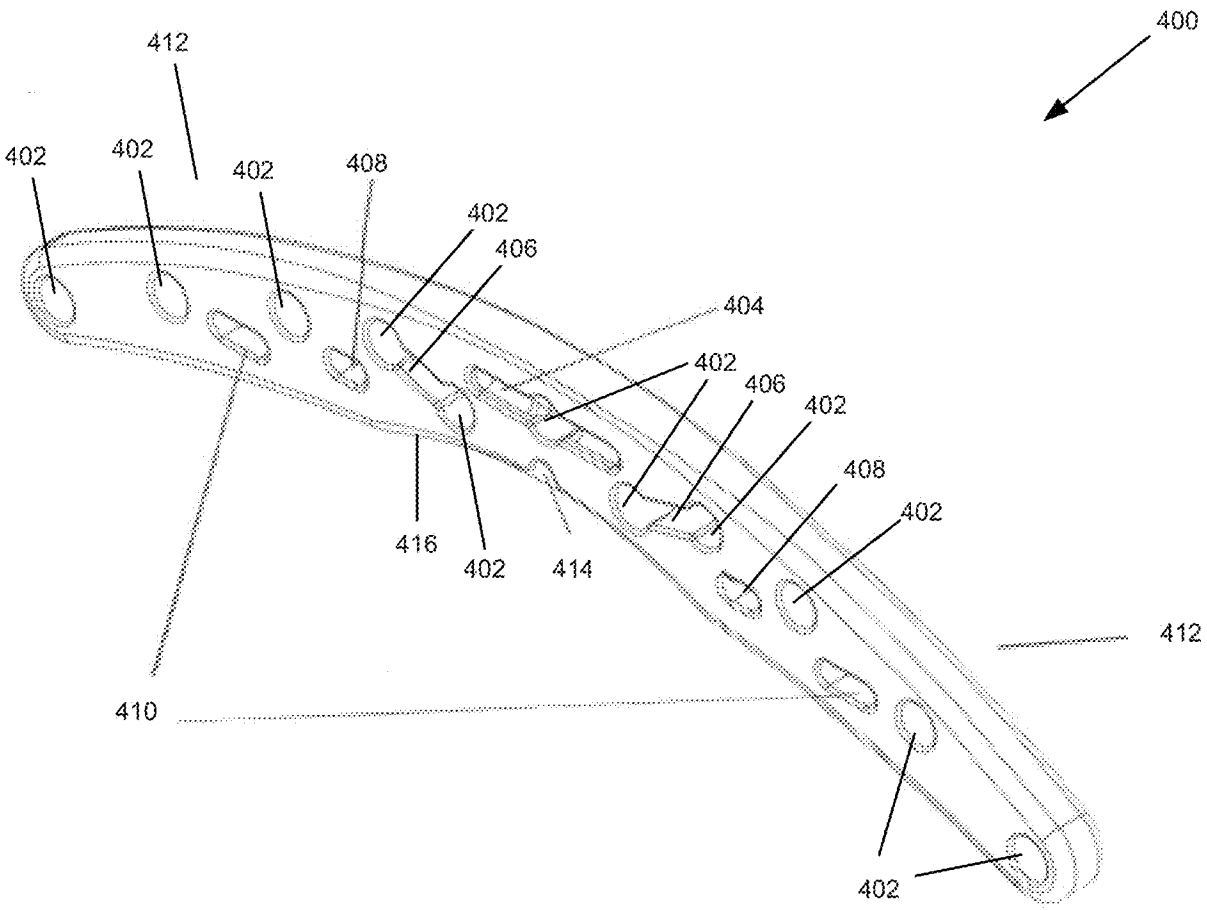
FIG. 7 is a perspective view of another workout device.
Figure 8:
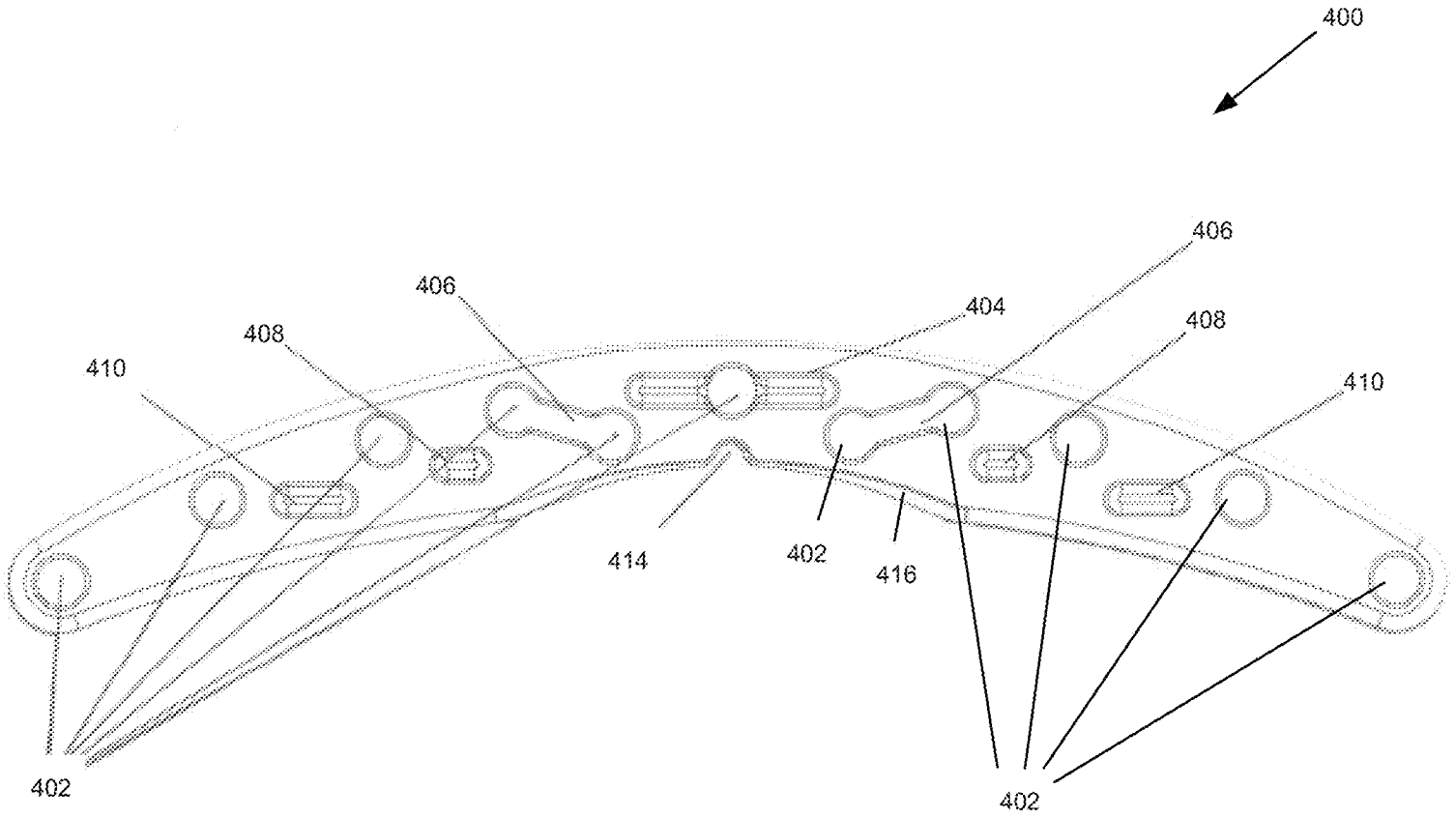
FIG. 8 is a front view of the workout device of FIG. 7.

In some embodiments, workout devices 100, 200, or 300 may include one or more openings and/or channels that may provide a plurality of grip positions and additional ergonomic features. For example, FIG. 7 and FIG. 8 depict a workout device 400 generally similar to workout device 100, workout device 400 comprising attachment points 402, a crimp hold 404, hand grips 406, two-finger pocket holds 408, three-finger pocket holds 410, limbs 412, a cervical notch 414, and a trapezius cradle 416.

Crimp hold 404 may be a void in workout device 400 that may allow a user to simulate grabbing an edge with their fingertips with fingers arched above the fingertips. Crimp hold 404 may extend through workout device 400 or may not extend through workout device 400.

Hand grips 406 may be a void in workout device 400 that may allow a user to hold workout device 400 with their hands. As depicted in FIG. 7 and FIG. 8, hand grips 406 may connect two attachment points 402, which are generally similar to attachment points 106 as described herein. Hand grips 406 may extend into and/or through workout device 400 or may not extend through workout device 400.

Two-finger pocket holds 408 and three-finger pocket holds 410 may be voids in workout device 400 that may allow a user to put two or three of their fingers through workout device 400 when holding it or hanging from it.

Limbs 412 of workout device 400, generally similar to limbs 104 of workout device 100, may act as a jug hold where one or more hands of a user may grip onto limbs 412.

Cervical notch 414 is similar to cervical notch 110 as described herein. Cervical notch 414 may be a groove in workout device 400 for accommodating the cervical spine of a user of workout device 400, which may reduce pressure applied on the cervical spine of the user from workout device 400 and may encourage the user to use workout device 400 ergonomically and encourage the user to practice proper form when exercising.

Trapezius cradle 416 may be a recess in workout device 400 that may create space for the upper trapezius muscles of a user when workout device 400 is laid across the upper back and/or shoulders of the user. Similar to cervical notch 414, trapezius cradle 416 may be located on the inner arc of workout device 400. As depicted in FIG. 7 and FIG. 8, cervical notch 414 may be manufactured into trapezius cradle 416.

Trapezius cradle 416 may increase contact surface between workout device 400 and the user, which may more evenly distribute the weight of workout device 400 onto the user. This may promote good ergonomics, continued blood flow (e.g. no pinching), and increase comfort for the user.

In some embodiments, workout devices 100, 200, 300, or 400 may have a segmented, articulated, or modular structure. For example, body 102 and/or limbs 104 of workout devices 100, 200, 300, or 400 may be separated into two or more parts, which may enable a range of angles to be created with workout devices 100, 200, 300, or 400. The separate parts of workout devices 100, 200, 300, or 400 may be fastened together using appropriate fastening devices, such as screws, nuts and bolts, clips, or geared joints. A modular structure may increase the portability of workout devices 100, 200, 300, or 400.

In some embodiments, workout devices 100, 200, 300 or 400 may be able to move laterally along the X-, Y-, and Z-axes, rotate about the X-, Y-, and Z-axes, or any combination thereof, as shown in FIG. 1, such as when attached to one or more anchors and/or loaded with one or more loads. Workout devices 100, 200, 300, or 400 may generate multidimensional forces along the X-, Y-, and/or Z-axes and/or generate multidimensional moments about the X-, Y-, and/or Z-axes when loaded. These multidimensional forces and/or moments may be generated while workout devices 100, 200, 300, or 400 may be suspended from a support or while atop a supporting surface, such as a floor or the ground.

In some embodiments, workout devices 100, 200, 300, or 400 may include wireless biofeedback capabilities using Bluetooth Low Energy technology, which may provide users of workout devices 100, 200, 300, or 400 with real-time or near real-time perspective on the relative balances and imbalances in the user's muscle groups and body while using workout devices 100, 200, 300, or 400, and/or whether users are using workout devices 100, 200, 300, or 400 in an ergonomic manner.

Workout devices 100, 200, 300, or 400 may be embedded with an accelerometer and/or gyroscopic sensor, which, based on the movement of workout devices 100, 200, 300, or 400, may determine the number of completed repetitions of an exercise and variation in orientation of workout devices 100, 200, 300, or 400. Variations in orientation of workout devices 100, 200, 300, or 400 may represent relative imbalances in the user's body as the user is exercising.

Workout devices 100, 200, 300, or 400 equipped with Bluetooth connectivity may transmit radio waves based on the readings of the embedded accelerometer and/or gyroscopic sensor. A device equipped with Bluetooth connectivity, such as a personal computer, workstation, server, portable computer, mobile device, personal digital assistant, laptop, tablet, smart phone, an interactive television, video display terminals, gaming consoles, electronic reading device, and portable electronic devices, or a combination thereof, may receive the radio waves transmitted by workout devices 100, 200, 300, or 400 and may process the radio waves with a processor and interpret the radio waves as relative balances and imbalances in the user's muscle groups in real-time or near real-time. The interpreted radio waves may be displayed on a display screen of the device to identify the relative balances and imbalances in the user's muscle groups and body and/or whether the user is exercising ergonomically.

The plurality of attachment points 106 may allow workout devices 100, 200, 300, or 400 to be configured or assembled in a plurality of ways. Workout devices 100, 200, 300, or 400 may be attached to one or more anchors at one or more attachment points 106, may be loaded with one or more loads at one or more attachment points 106, may be used with a combination of anchors and/or loads, or may be used with no anchors and/or no loads.

Figure 9:
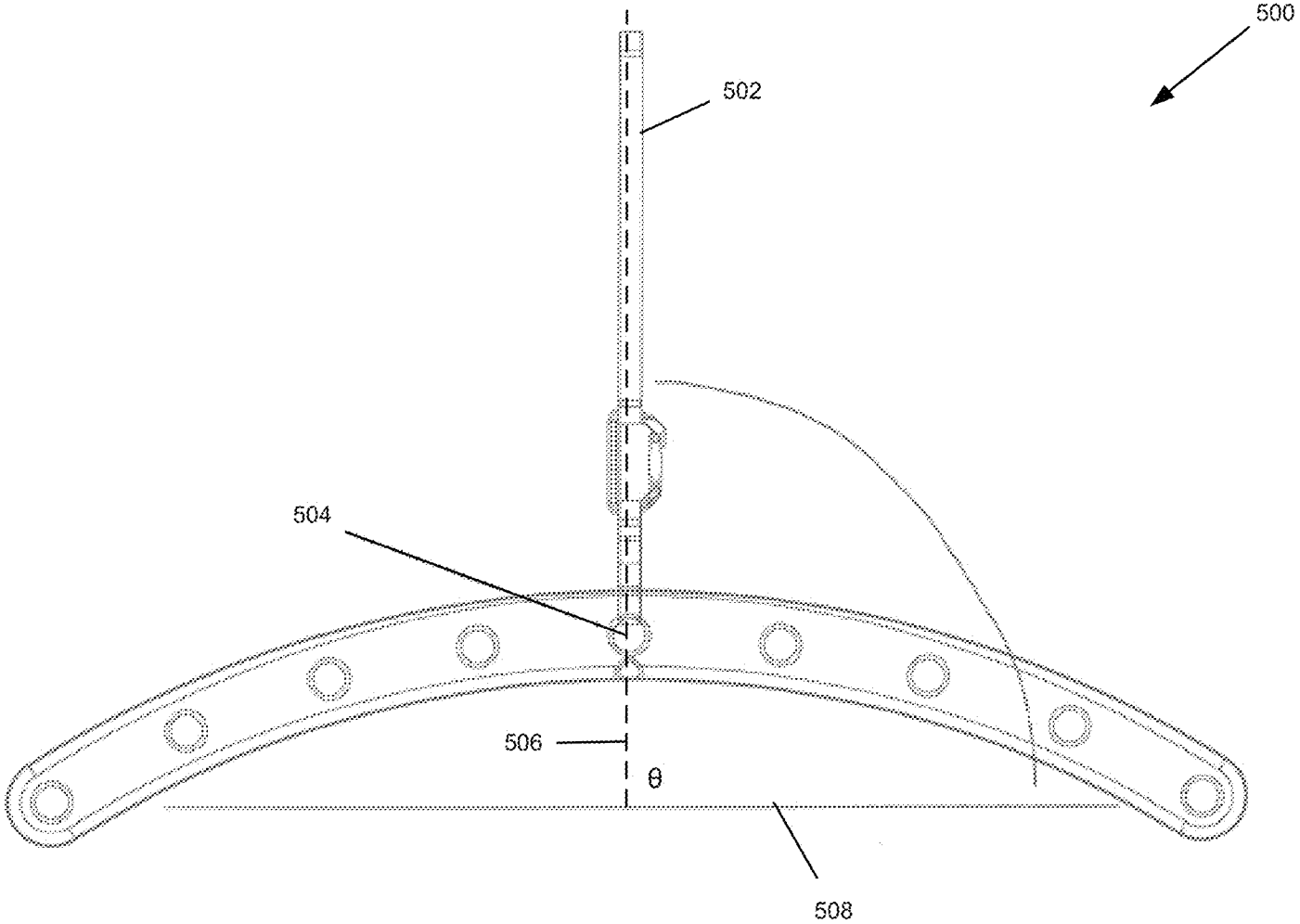
FIG. 9 is a schematic view of suspension of the workout device of FIG. 1 from a single centre attachment point.

In some embodiments, workout devices 100, 200, 300, or 400 may be anchored at a single attachment point 106. As depicted in FIG. 9, a workout device 500 generally similar to workout device 100 may be attached to an anchor 502 at a centre attachment point 504.

Anchor 502 may be attached to workout device 500 at an attachment point 106, such as centre attachment point 502, on one end, and secured on the other end, such as to a ceiling. For example, anchor 502 may be a strap, a rope, a chain, or as depicted in FIG. 9, a combination of straps and a carabiner, or another appropriate anchoring device.

Anchor 502 attached at centre attachment point 504 may cause workout device 500 to behave as a balanced lever. As depicted in FIG. 9, an angle $\theta$ formed between a longitudinal axis 506 running along anchor 502 and an axis 508 intersecting two attachment points 106 symmetric about centre attachment point 504 is generally 90°.

Figure 10:
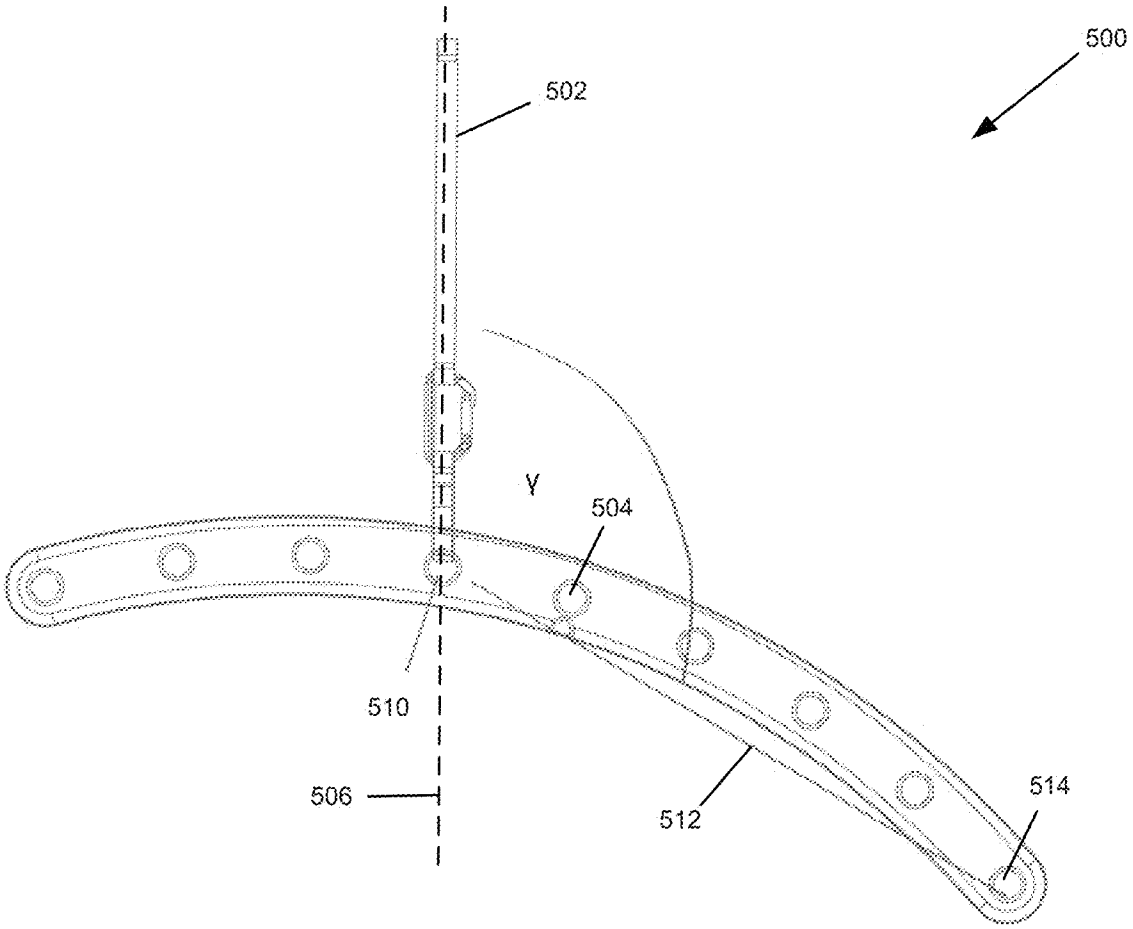
FIG. 10 is a schematic view of suspension of the workout device of FIG. 1 from a single off-centre attachment point.

In some embodiments, workout device 500 may be attached to an anchor 502 at an attachment point other than centre attachment point 504. As depicted in FIG. 10, anchor 502 is attached at an attachment point 510 offset from centre attachment point 504, which may cause workout device 500 to behave as an imbalanced lever. As depicted in FIG. 10, an angle $\gamma$ formed between longitudinal axis 506 and an axis 512 intersecting attachment point 510 and an attachment point 514 is generally greater than 90°.

In some embodiments, workout device 500 may be attached to anchor 502 at an attachment point most distal from centre attachment point 504, such that the entire length of workout device 500 hangs vertically downward from anchor 502.

In some embodiments, workout devices 100, 200, 300, or 400 may be anchored at two attachment points 106.

Figure 11:
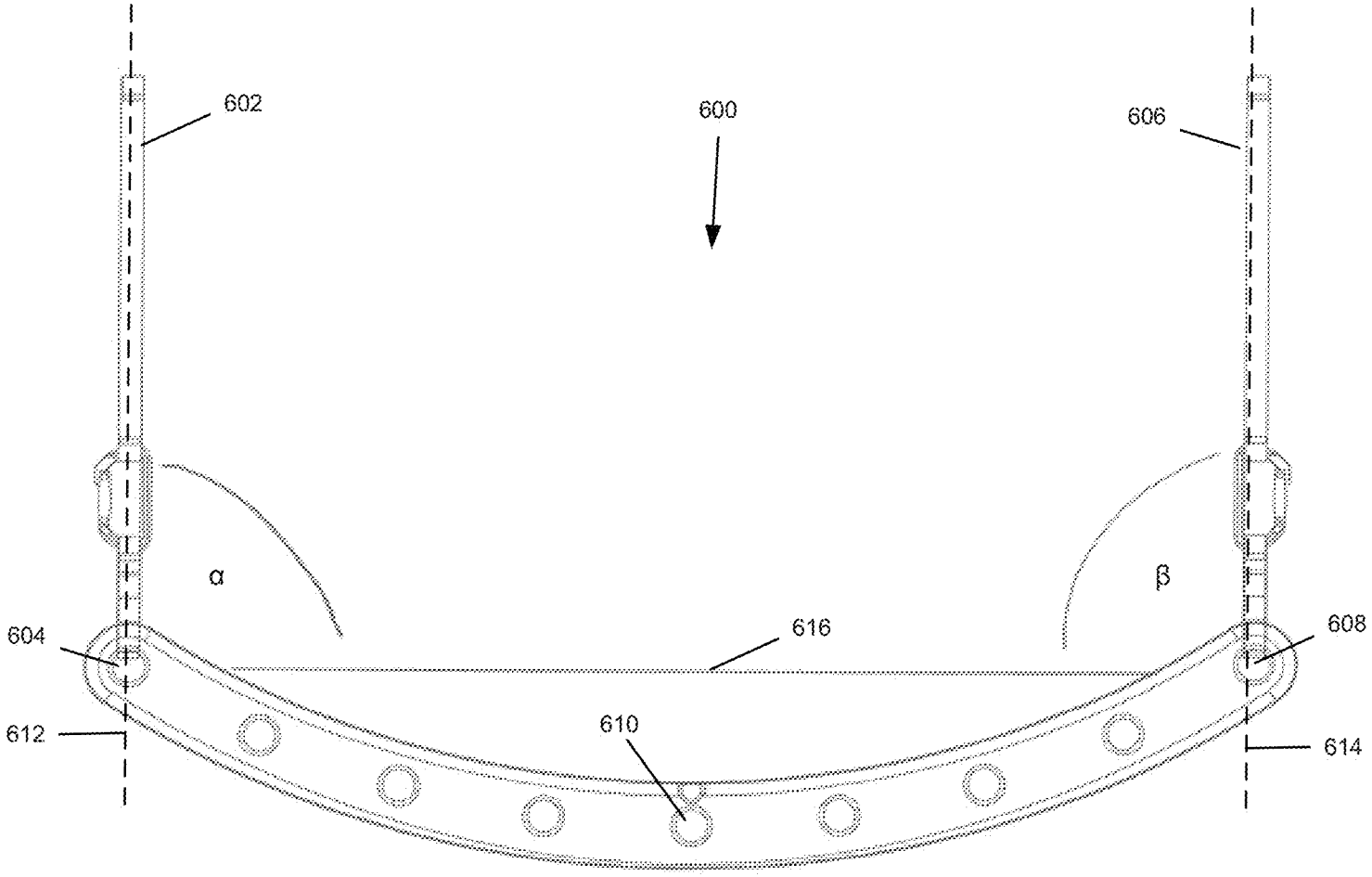
FIG. 11 is a schematic view of symmetric inverted suspension of the workout device of FIG. 1 from two attachment points.

For example, FIG. 11 depicts a workout device 600 generally similar to workout device 100 that may be attached to two anchors, each at an attachment point. The two attachment points may be symmetrical about the centre of workout device 600. As shown in FIG. 11, workout device 600 may be attached to an anchor 602 at an attachment point 604 and to an anchor 606 at an attachment point 608.

Attachment points 604 and 608 may be symmetric about a centre attachment point 610. As depicted in FIG. 11, attachment points 604 and 608 are at distal ends of workout device 600, and at equal and opposite distance from centre attachment point 610.

When workout device 600 is attached to anchors 602 and 606 at attachment points 604 and 608 as depicted in FIG. 11, an angle α formed between a longitudinal axis 612 along anchor 602 and an axis 616 intersecting attachment points 604 and 608 is generally 90°. Similarly, an angle β formed between a longitudinal axis 614 along anchor 606 and axis 616 is generally 90°.

When workout device 600 is attached to anchors 602 and 606 at attachment points sufficiently distal from centre attachment point 610, such as at attachment points 604 and 608, it may cause workout device 600 to be symmetrically and invertedly suspended, as shown in FIG. 11.

Figure 12:
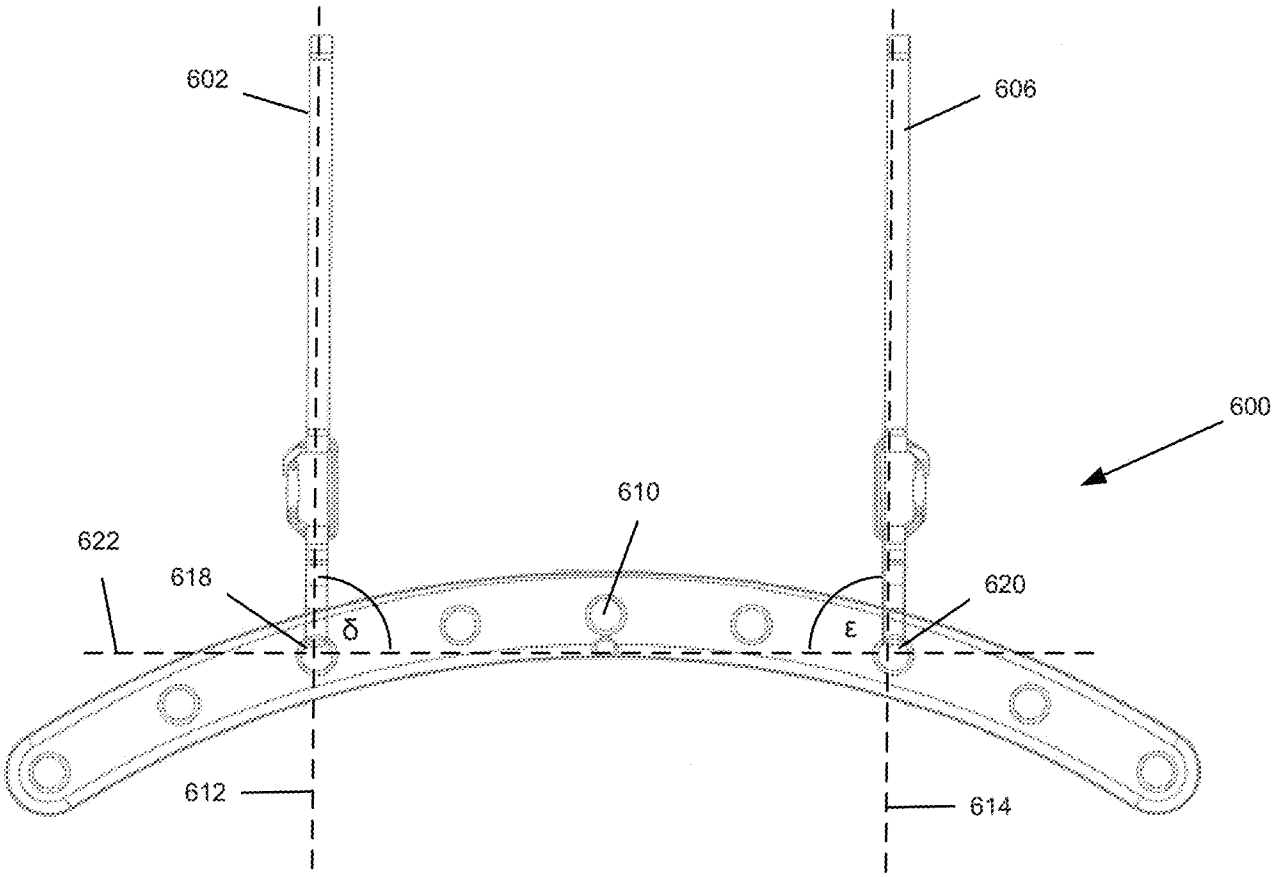
FIG. 12 is a schematic view of symmetric suspension of the workout device of FIG. 1 from two attachment points.

In some embodiments, workout device 600 may be attached to anchors 602 and 606 at attachment points more proximate to centre attachment point 610. As depicted in FIG. 12, anchor 602 may be attached to workout device 600 at an attachment point 618, and anchor 606 may be attached to workout device 600 at an attachment point 620.

When workout device 600 is attached to anchors 602 and 606 at attachment points 618 and 620 as depicted in FIG. 12, an angle δ formed between longitudinal axis 612 and an axis 622 intersecting attachment points 618 and 620 is generally 90°. Similarly, an angle ε formed between longitudinal axis 614 and axis 622 is generally 90°.

When workout device 600 is attached to anchors 602 and 606 at attachment points sufficiently proximate to centre attachment point 610, such as at attachment points 618 and 620, it may cause workout device 600 to be symmetrically suspended, as shown in FIG. 12.

Figure 13:
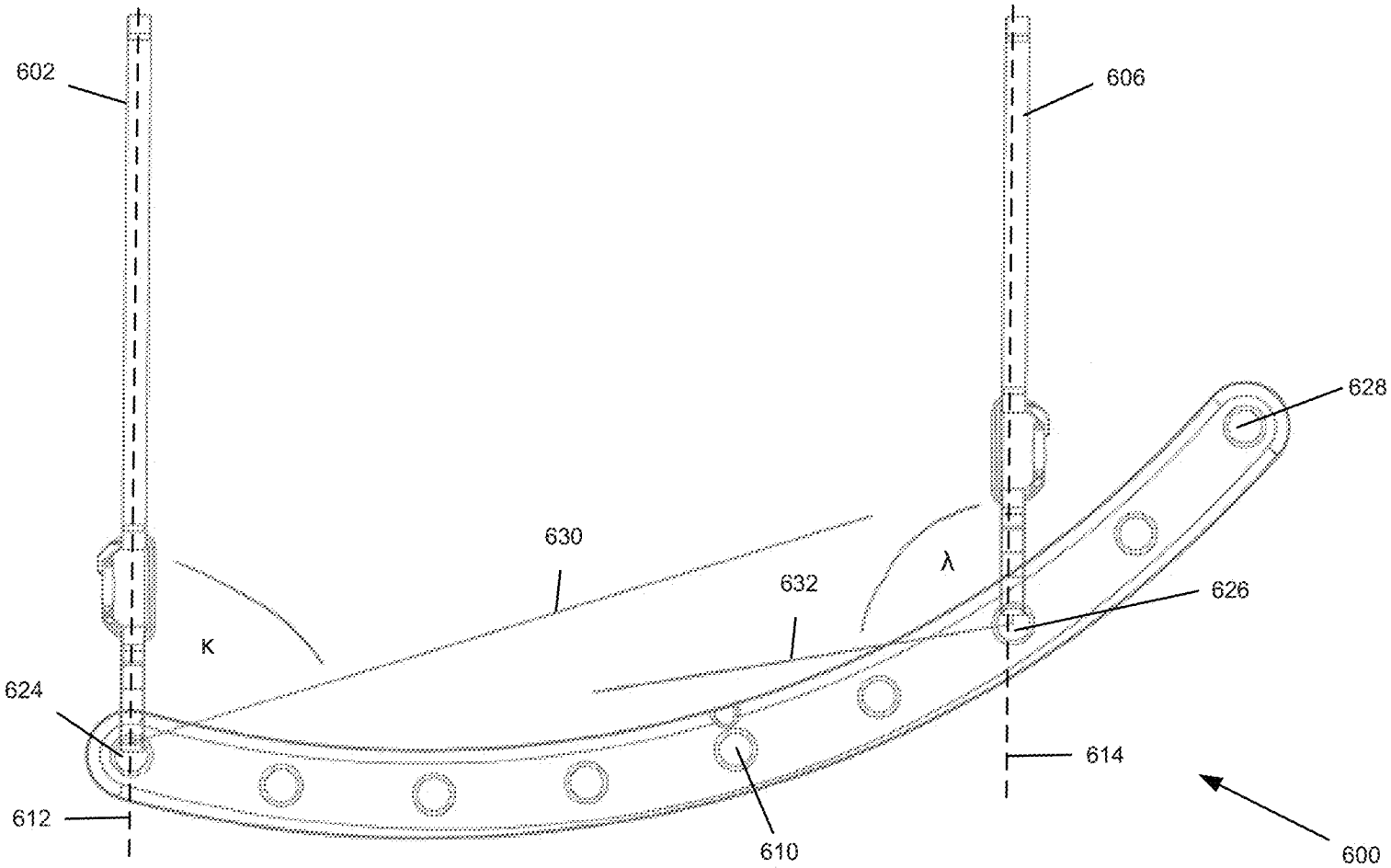
FIG. 13 is a schematic view of asymmetric inverted suspension of the workout device of FIG. 1 from two attachment points.

In some embodiments, workout device 600 may be attached to anchors at two attachment points, and the two attachment points may be asymmetrical about the centre of workout device 600. As shown in FIG. 13, workout device 600 may be attached to anchor 602 at an attachment point 624 and to anchor 606 at an attachment point 626.

Attachment points 624 and 626 may be asymmetrical about the centre of workout device 600. As depicted in FIG. 13, attachment point 624 is at a distal end of workout device 600, whereas attachment point 626 is located between centre attachment point 610 and a distal attachment point 628.

When workout device 600 is attached to anchors 602 and 606 at attachment points 624 and 626 as depicted in FIG. 13, an angle κ formed between longitudinal axis 612 and an axis 630 intersecting attachment points 624 and 628 is generally less than 90°. An angle λ formed between longitudinal axis 614 and an axis 632 intersecting attachment points 624 and 626 is generally greater than 90°.

When workout device 600 is attached to anchors 602 and 606 at attachment points sufficiently distal from each other, such as at attachment points 624 and 626, it may cause workout device 600 to be asymmetrically and invertedly suspended, as shown in FIG. 13.

Figure 14:
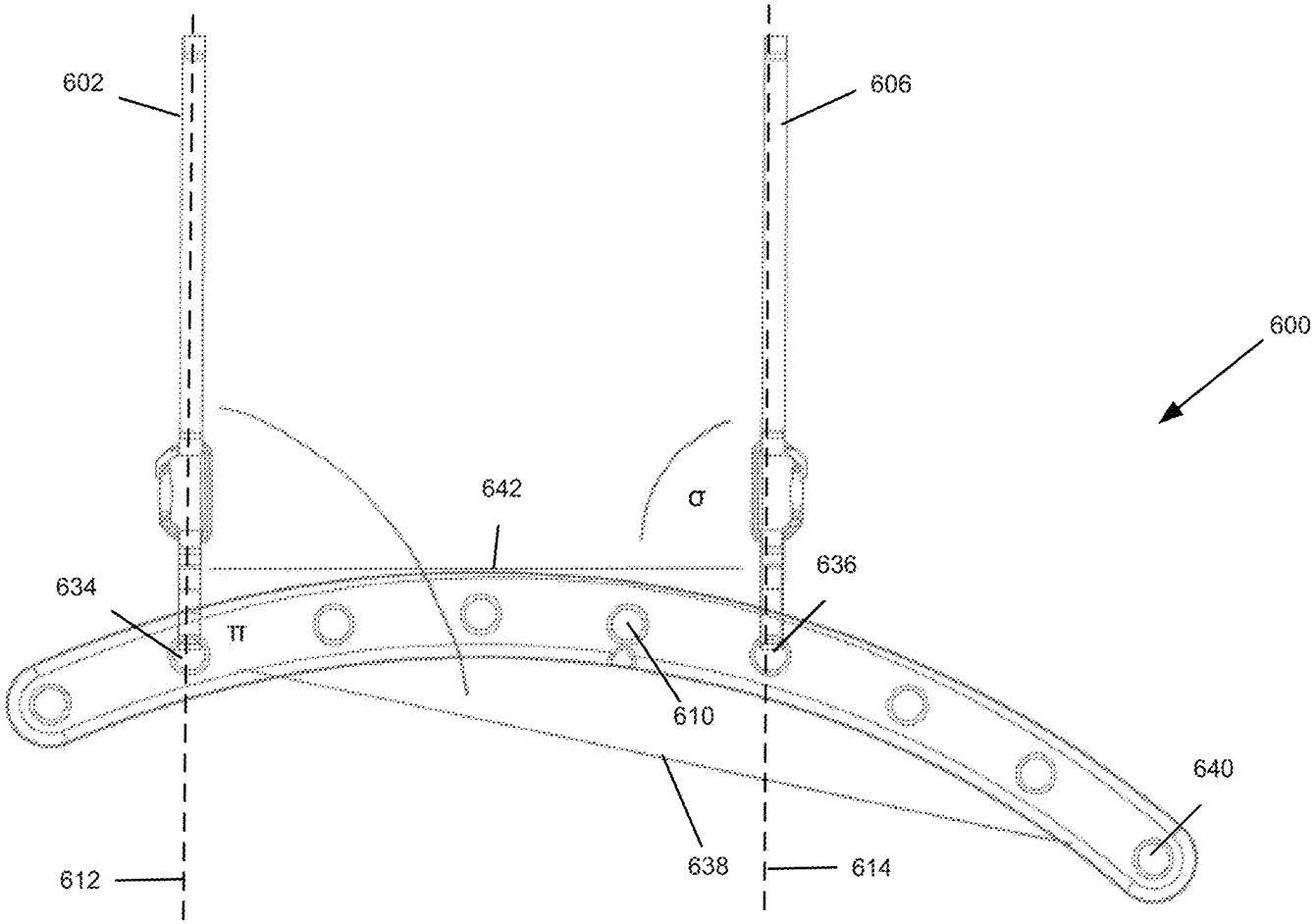
FIG. 14 is a schematic view of asymmetric suspension of the workout device of FIG. 1 from two attachment points.

In some embodiments, workout device 600 may be attached to anchors 602 and 606 at attachment points more proximate to each other. As depicted in FIG. 14, anchor 602 may be attached to workout device 600 at an attachment point 634, and anchor 606 may be attached at an attachment point 636.

When workout device 600 is attached to anchors 602 and 606 at attachment points 634 and 636 as depicted in FIG. 14, an angle π formed between longitudinal axis 612 and an axis 638 connecting attachment points 634 and 640 is generally greater than 90°. An angle σ formed between longitudinal axis 614 and an axis 642 intersecting attachment point 634 and attachment point 636 is generally 90°.

When workout device 600 is attached to anchors 602 and 606 at attachment points sufficiently proximate to centre attachment point 610, such as at attachment points 634 and 636, it may cause workout device 600 to be asymmetrically suspended, as shown in FIG. 14.

When anchored at two attachment points, workout devices 100, 200, 300, or 400 may be free to pivot about an axis intersecting the two attachment points.

The weight of the portion of workout devices 100, 200, 300, or 400 below said axis and the weight of the portion of workout devices 100, 200, 300, or 400 above said axis may determine if workout devices 100, 200, 300, or 400 may be suspended regularly or suspended invertedly.

If the weight of the former is greater than the weight of the latter, then workout devices 100, 200, 300, or 400 may be suspended invertedly. If the weight of the former is less than the weight of the latter, then workout devices 100, 200, 300, or 400 may be suspended regularly.

For example, workout devices 100, 200, 300, or 400 may be suspended from two attachment points 106, such as in the manner as shown in FIG. 12 and FIG. 14. As depicted, workout devices 100, 200, 300, or 400 may be suspended regularly. A load may be attached to an attachment point 106 between attachment points 618 and 620 as shown in FIG. 12 or attachment points 634 and 636 as shown in FIG. 14. The load may be heavy enough such that the weight of the portion of workout devices 100, 200, 300, or 400 below an axis connecting attachment points 618 and 620 or attachment points 634 and 636 may become greater than the weight of the portion of workout devices 100, 200, 300, or 400 above said axis. This may cause workout devices 100, 200, 300, or 400 suspended as depicted in FIG. 12 and FIG. 14 to invert their suspension orientation and be suspended in the manner as depicted in FIG. 11 and FIG. 13.

In some embodiments, workout devices 100, 200, 300, or 400 may be connected to each other in parallel or in series.

Figure 15:
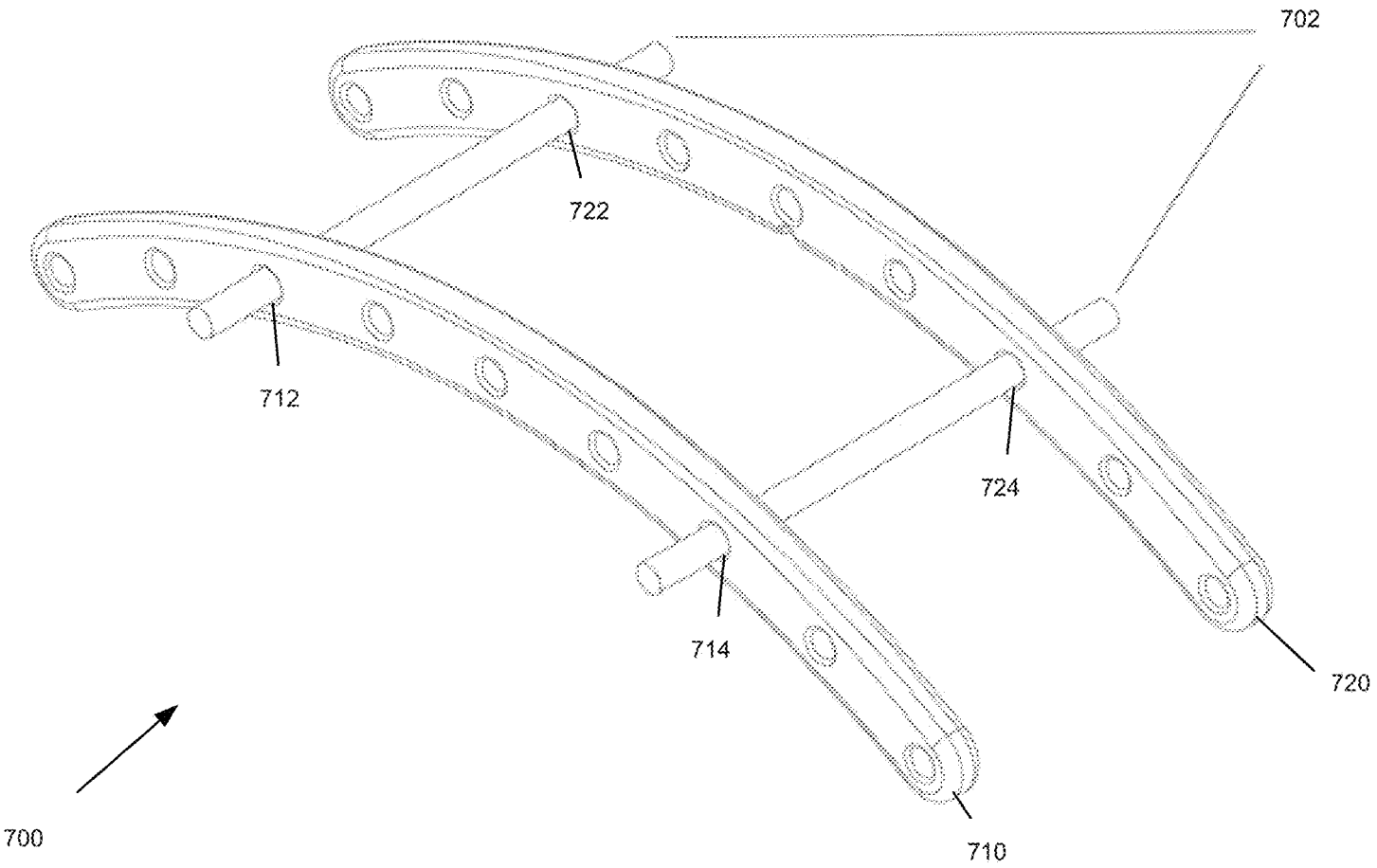
FIG. 15 is a perspective view of two workout devices of FIG. 1 configured as a parallette.
Figure 16:
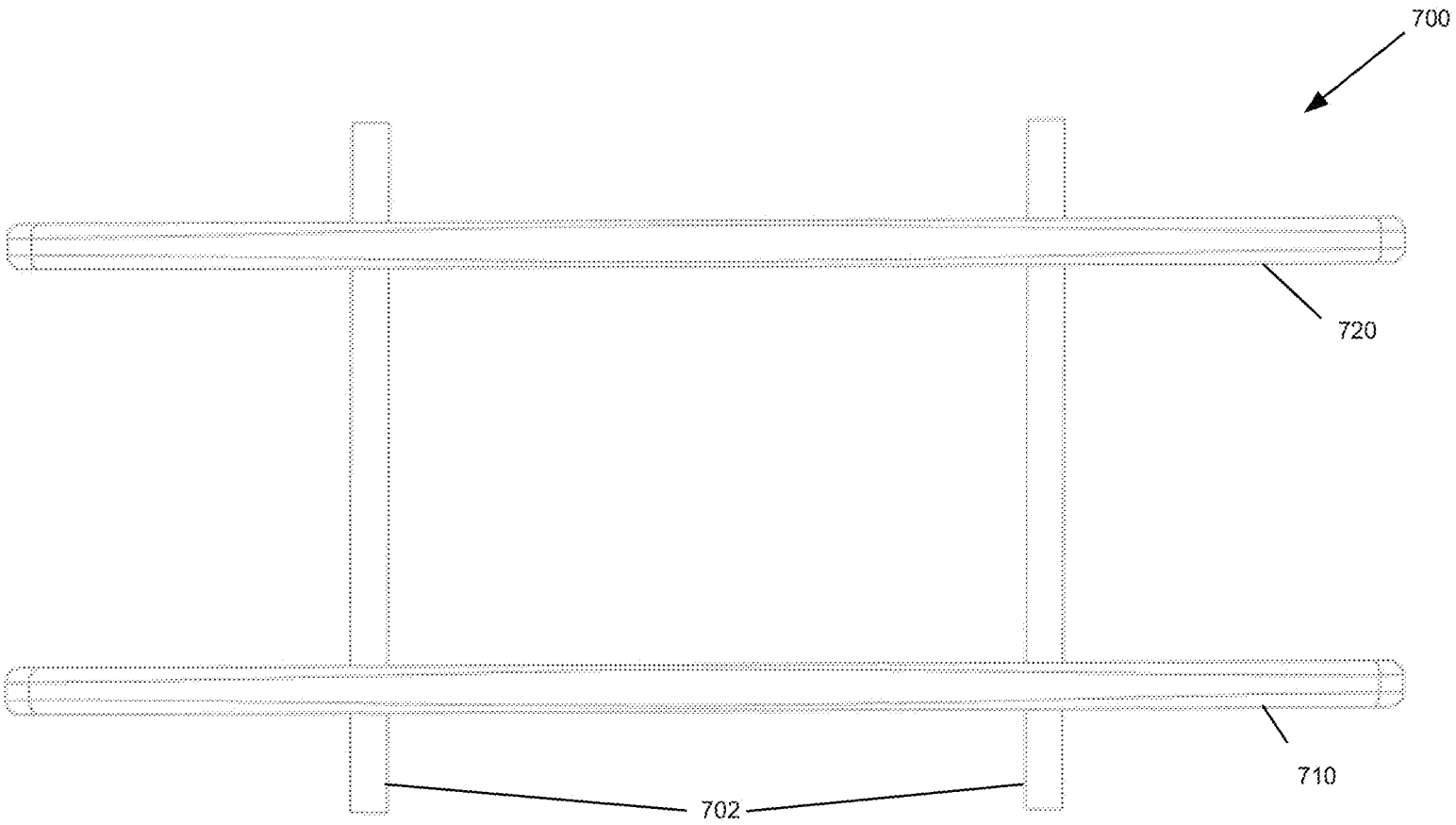
FIG. 16 is a top view of two workout devices of FIG. 1 configured as the parallette of FIG. 15.
Figure 17:
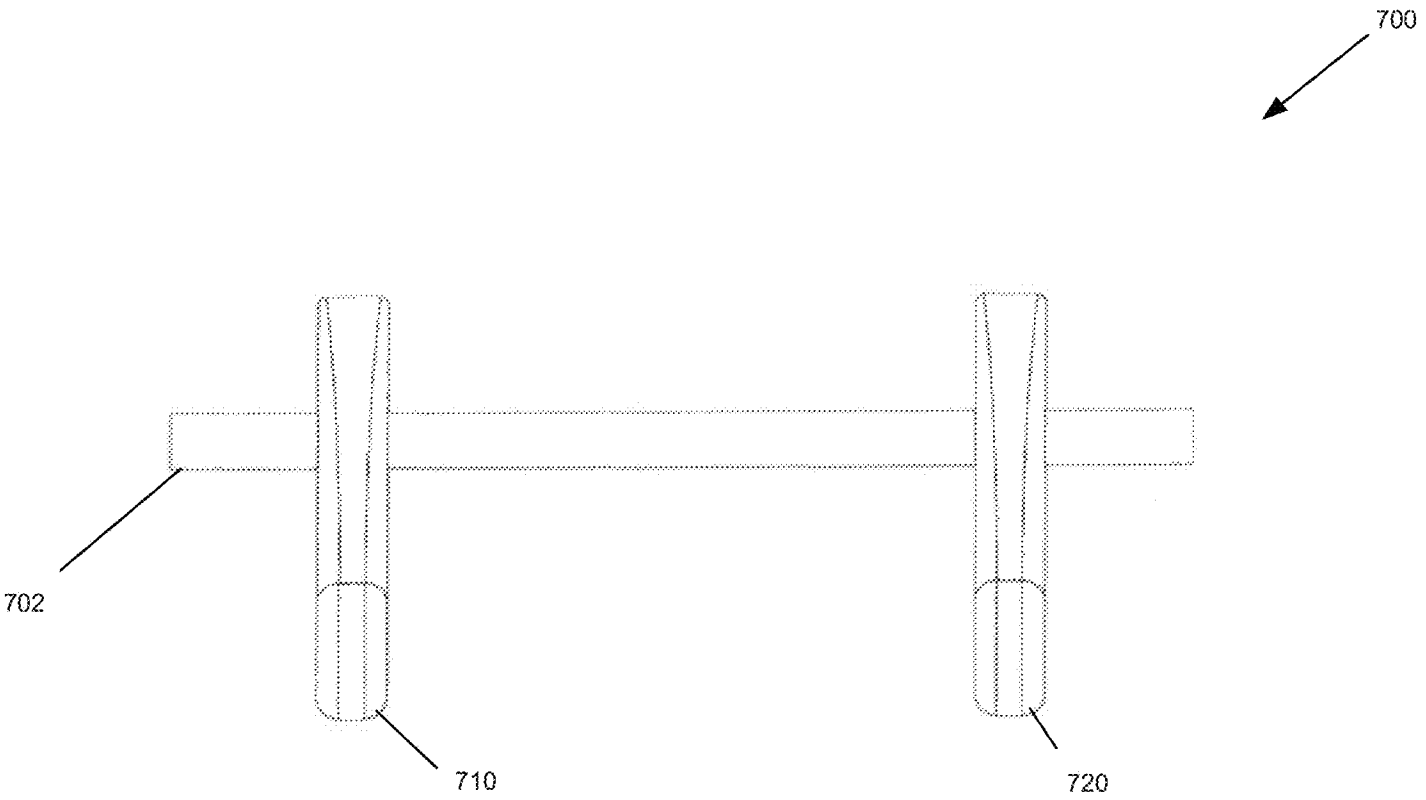
FIG. 17 is a right side view of two workout devices of FIG. 1 configured as the parallette of FIG. 15.

For example, two workout devices may be connected in parallel using dowels or rods. As depicted in FIG. 15, FIG. 16, and FIG. 17, a parallette 700 may be formed with two crossbars 702 connecting a workout device 710 and a workout device 720. Crossbars 702 may be inserted through attachment points 712 and 714 of workout device 710 and through attachment points 722 and 724 of workout device 720.

In some embodiments, crossbars 702 may be free to rotate or may be fixed when inserted through attachment points 712 and 714 of workout device 710 and through attachment points 722 and 724 of workout device 720.

Attachment points 712 and 714 of workout device 710 may correspond to attachment points 722 and 724 such that crossbars 702 may be generally perpendicular to workout devices 710 and 720.

FIG. 15, FIG. 16, and FIG. 17 illustrate workout devices 710 and 720 as generally similar to workout device 100. In some embodiments, workout device 710 and workout device 720 may be any of workout devices 100, 200, 300, or 400. Crossbars 720 may be standard dowels or rods, or another appropriate crossbar to connect workout device 710 and workout device 720 in parallel. Crossbars 720 may be made of wood, metal, plastic, or another appropriate material.

In some embodiments, a workout device, such as any of workout device 100, 200, 300, or 400 may be connected to another workout device, such as any of workout device 100, 200, 300, or 400 in series using seams, which may comprise two pegs. Multiple workout devices may be connected in series, for example, to create a circular shape made of a plurality of workout devices 100, 200, 300, and/or 400.

Crossbars 702 and pegs may be secured to workout devices 100, 200, 300, or 400 using appropriate securing devices, such as cotter pins.

In some embodiments, workout devices 100, 200, 300, 400 or 700 may be loaded with one or more loads. The loads may include appropriate attachment devices to attach additional loads, buckets, loading pins, Olympic weights, standard weights, kettlebells, bags, bladders, cinder blocks, a user, any other appropriate object, or a combination thereof. The one or more loads may be applied to, attached or hitched to workout devices 100, 200, 300, 400 or 700 using appropriate attachment devices, such as a user's hands, wide-gait carabiners, climbing slings, cables, ropes, chains, cam-buckle straps, elastic bands, rubber bands, and the like. For example, a human user may hold workout devices 100, 200, 300, 400 or 700 at body 102 or limbs 104. As another example, weights may be attached to workout devices 100, 200, 300, 400 or 700 using ropes or chains.

Appropriate loads may be applied to, attached, or hitched to workout devices 100, 200, 300, 400 or 700 whether or not workout devices 100, 200, 300, 400 or 700 are attached to one or more anchors at one or more attachment points as described herein. Workout devices 100, 200, 300, 400, or 700 may be attached to one or anchors for suspension training. Workout devices 100, 200, 300, 400, or 700 may not be attached to an anchor to simulate a bar for bar-based weight training. In some embodiments, workout devices 100, 200, 300, 400 or 700 may be loaded symmetrically atop a supporting surface, such as a floor or the ground.

The one or more loads may be attached to workout devices 100, 200, 300, 400 or 700 symmetrically about the centre of workout devices 100, 200, 300, 400 or 700.

Figure 18:
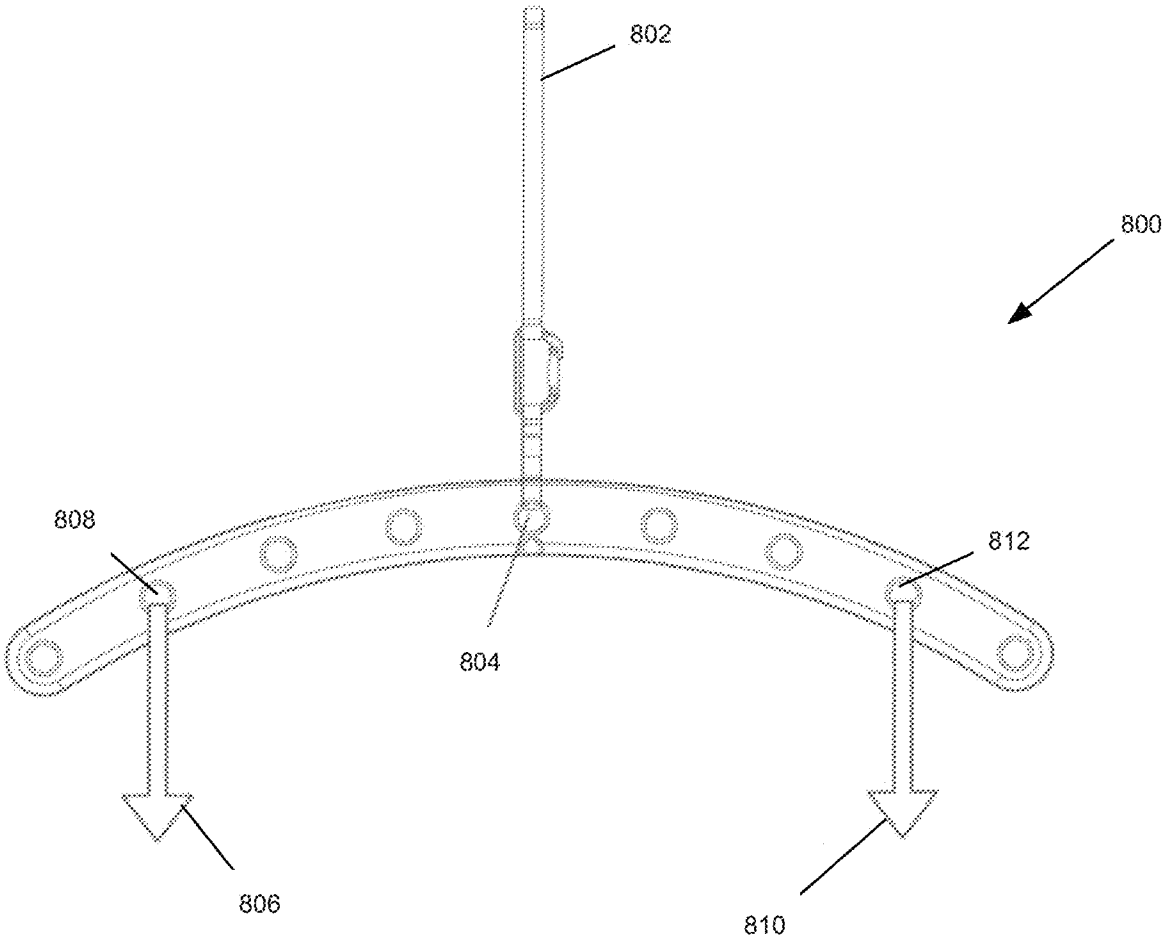
FIG. 18 is a schematic view of two loads applied symmetrically to the workout device of FIG. 1 in suspension from a single centre attachment point.

For example, FIG. 18 depicts a workout device 800 generally similar to workout device 100, attached to an anchor 802 at a centre attachment point 804. Workout device 800 may be any of workout devices 100, 200, 300, 400 or 700. Workout device 800 may be attached to an anchor 802 at an attachment point other than at centre attachment point 804, or may be attached to more than one anchor at one or more attachment points, or may not be attached to any anchors. A load 806 is attached to workout device 800 with an appropriate attachment device at an attachment point 808, and a load 810 is attached to workout device 800 with an appropriate attachment device at an attachment point 812.

As illustrated in FIG. 18, load 806 and load 810 are at a distance equal to and opposite from centre attachment point 804, such that if load 806 and load 810 are the same, workout device 800 should act as a balanced lever.

Workout device 800 may be loaded with a plurality of loads for performing a variety of exercises.

Figure 19:
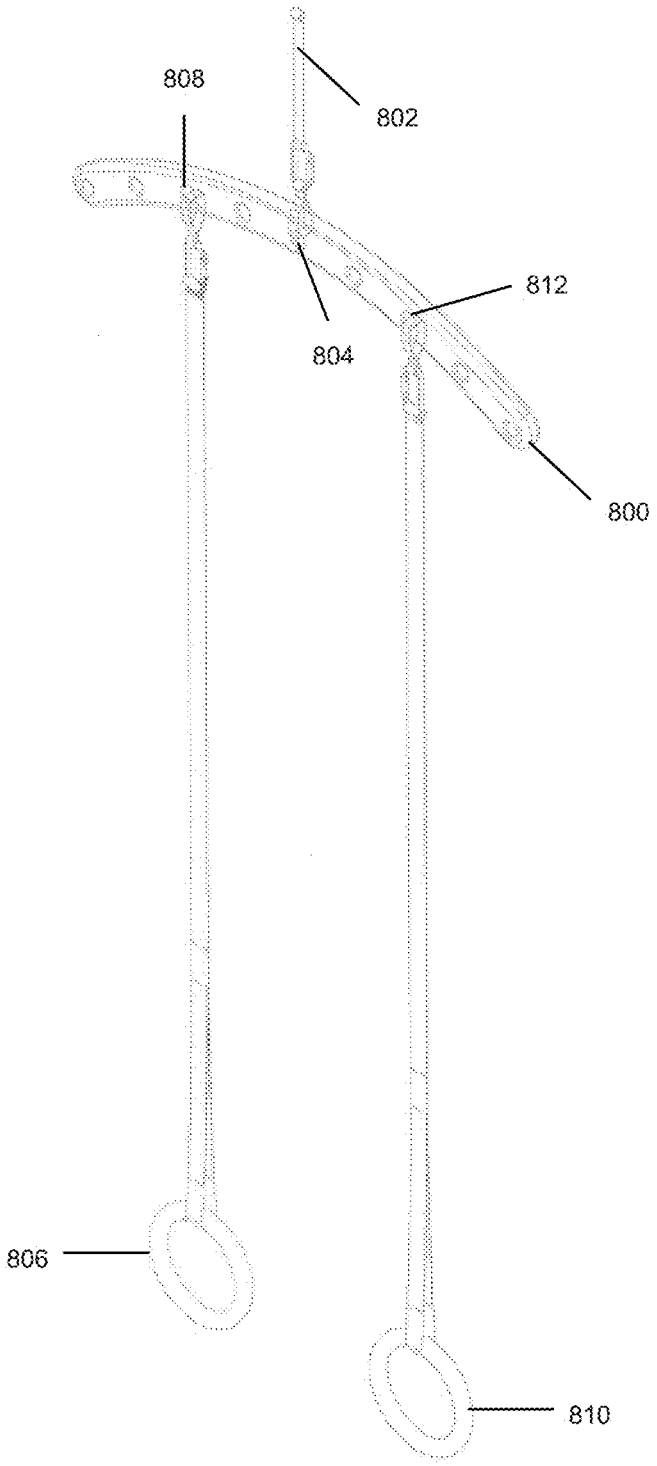
FIG. 19 is a schematic view of floor rings attached to the workout device of FIG. 1 suspended from a single centre attachment point.
Figure 20:
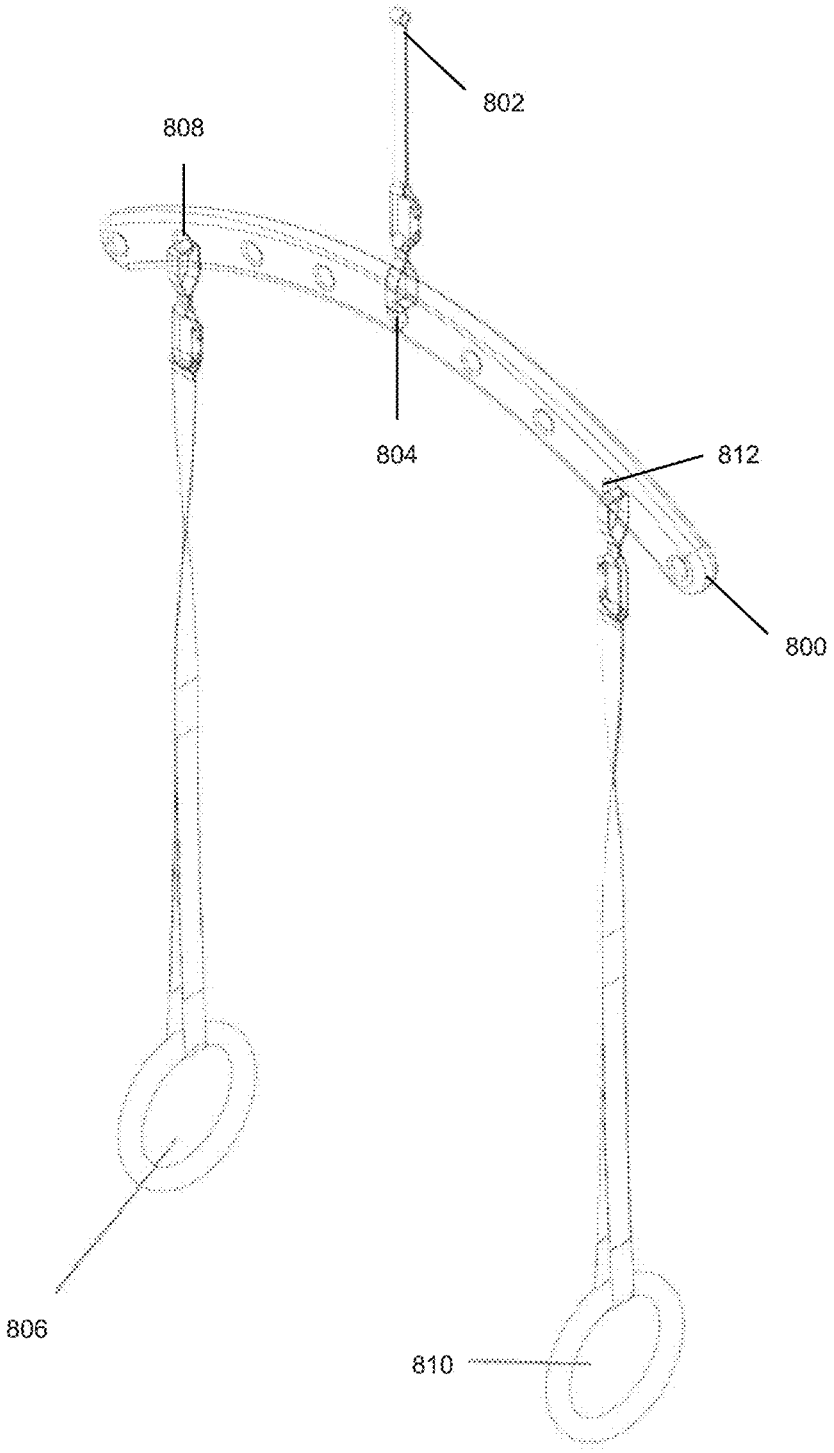
FIG. 20 is a schematic view of rings attached to the workout device of FIG. 1 suspended from a single centre attachment point.

For example, FIG. 19 and FIG. 20 depict workout device 800 attached to anchor 802 at centre attachment point 804. As depicted, load 806 and load 810 are rings attached to workout device 800 with a combination of straps and carabiners where additional loads may be attached and suspended therefrom.

Figure 21:
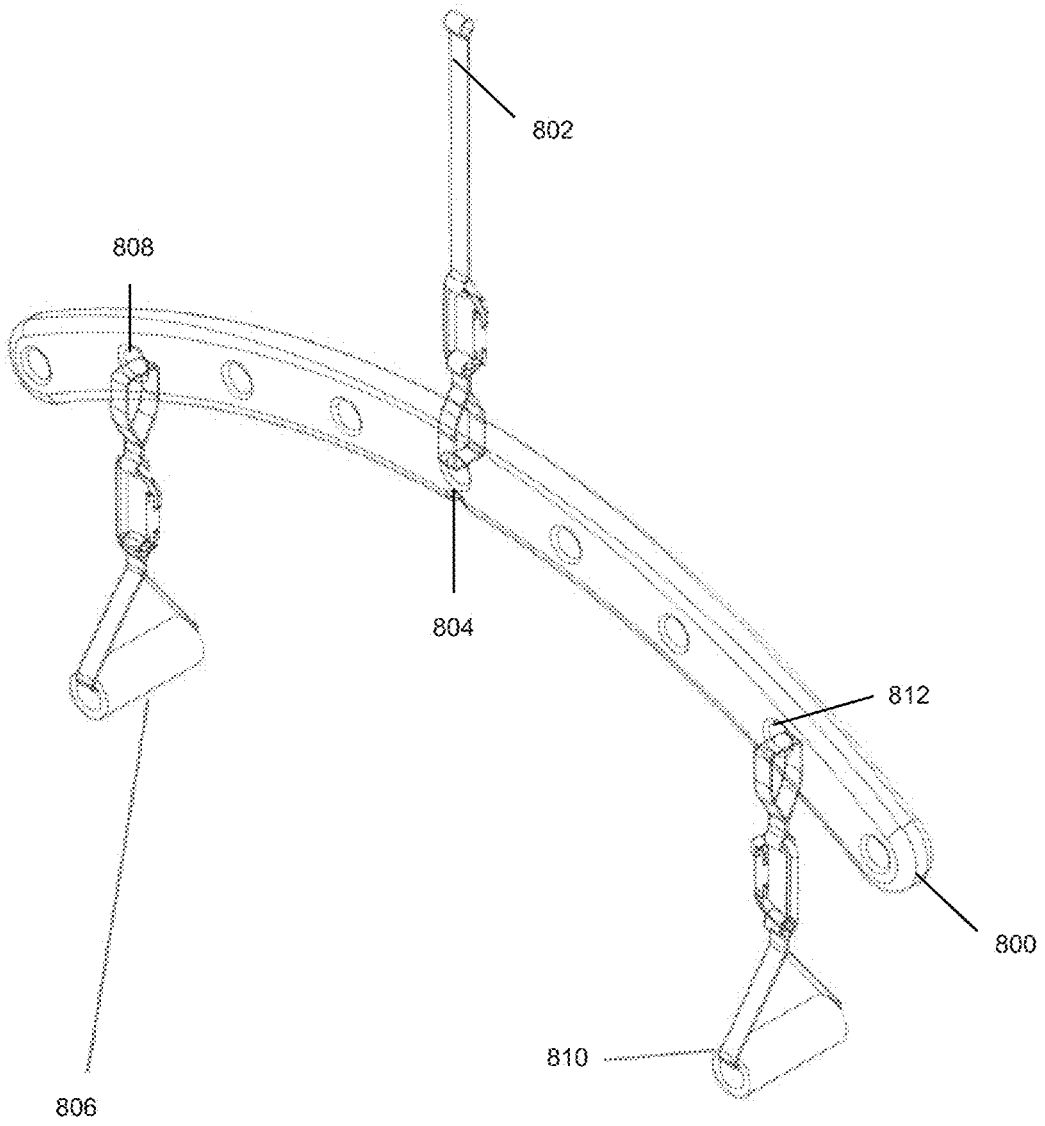
FIG. 21 is a schematic view of handles attached to the workout device of FIG. 1 suspended from a single centre attachment point.

As another example, FIG. 21 depicts workout device 800 attached to anchor 802 at centre attachment point 804. As depicted, load 806 and load 810 are handles attached to workout device 800 with a combination of straps and carabiners where additional loads may be attached and suspended therefrom.

Figure 22:
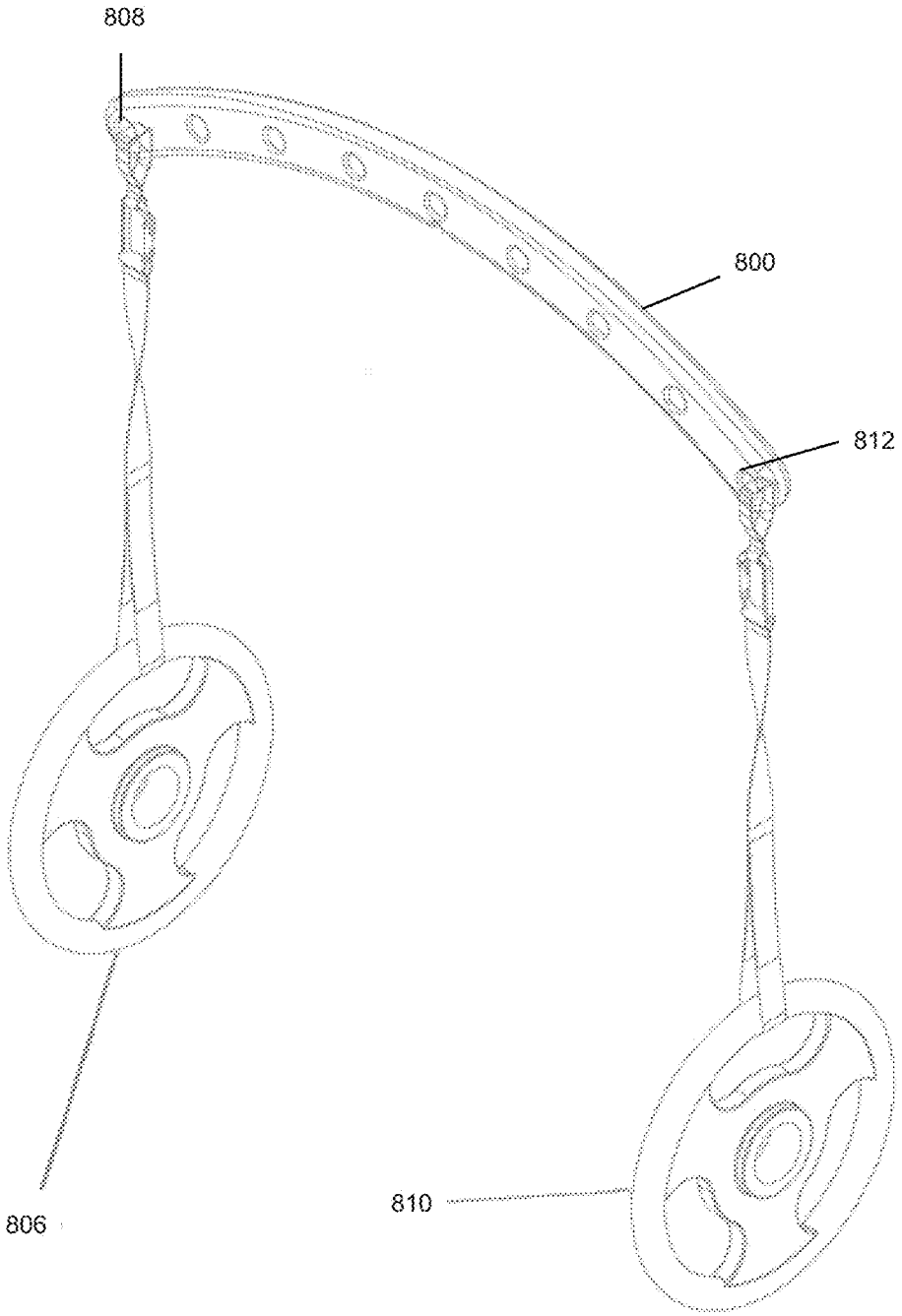
FIG. 22 is a schematic view of weight plates attached to the workout device of FIG. 1.

As yet another example, FIG. 22 depicts workout device 800 attached to anchor 802 at centre attachment point 804. As depicted, load 806 and load 810 are weight plates attached to workout device 800 with a combination of straps and carabiners.

Figure 23:
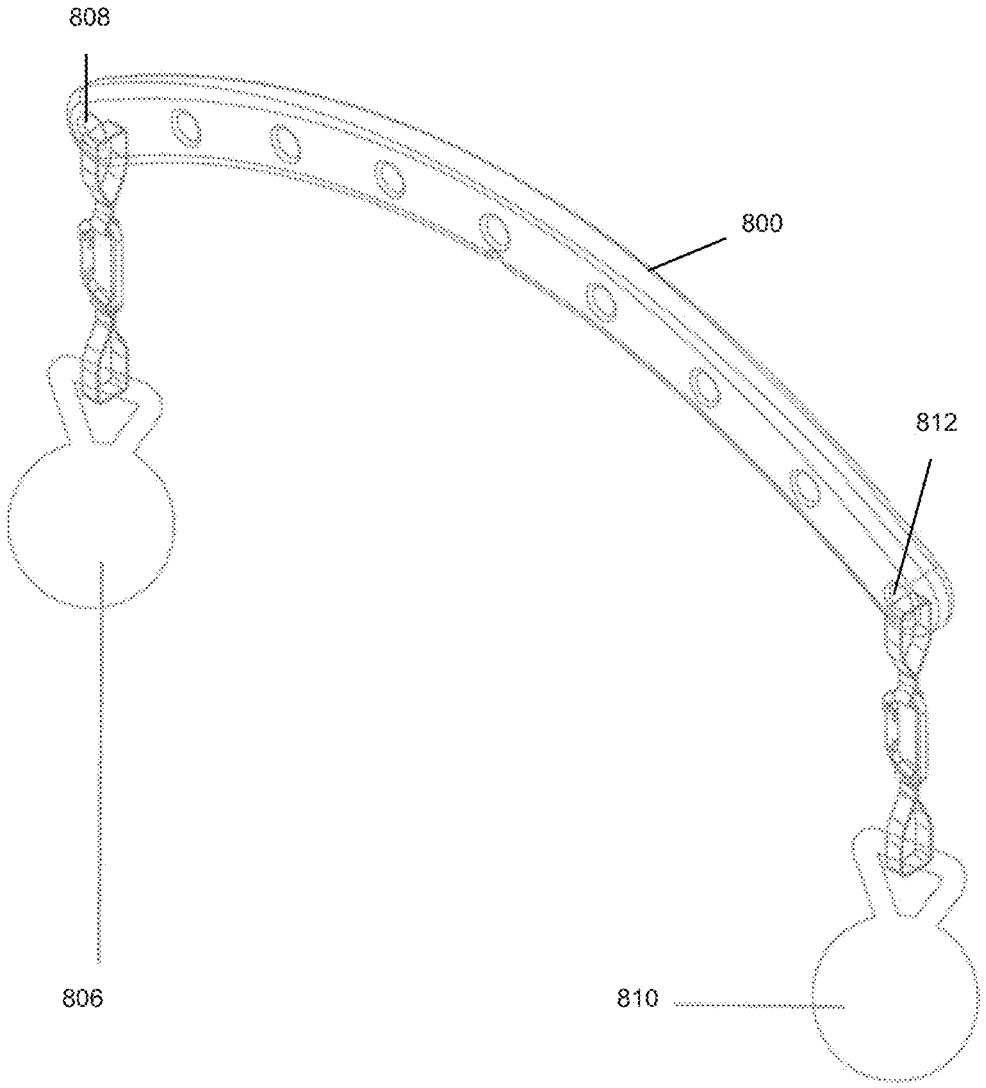
FIG. 23 is a schematic view of kettlebells attached to the workout device of FIG. 1.

As another example, FIG. 23 depicts workout device 800 where load 806 and load 810 are kettlebells and attached to workout device 800 with a combination of straps and carabiners.

Figure 24:
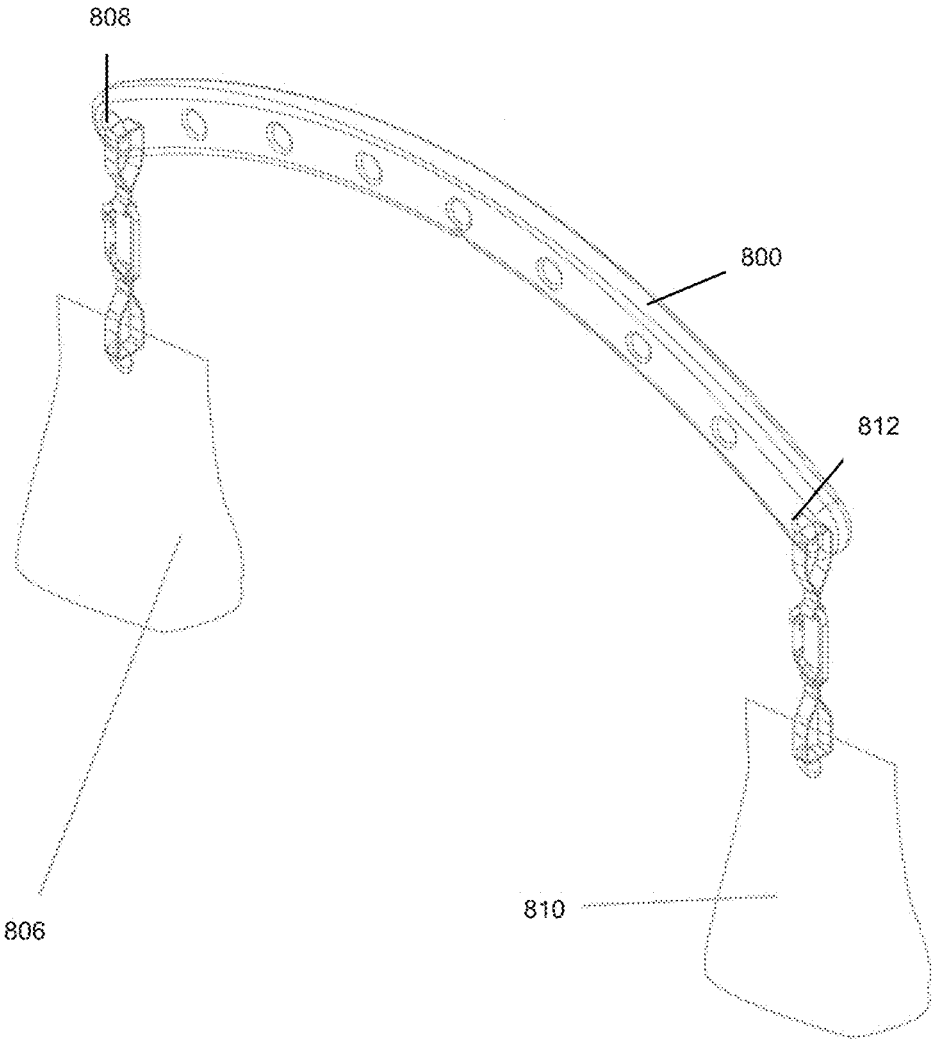
FIG. 24 is a schematic view of bladders attached to the workout device of FIG. 1.

As yet another example, FIG. 24 depicts workout device 800 where load 806 and load 810 are bladders or bags and attached to workout device 800 with a combination of straps and carabiners.

Figure 25:
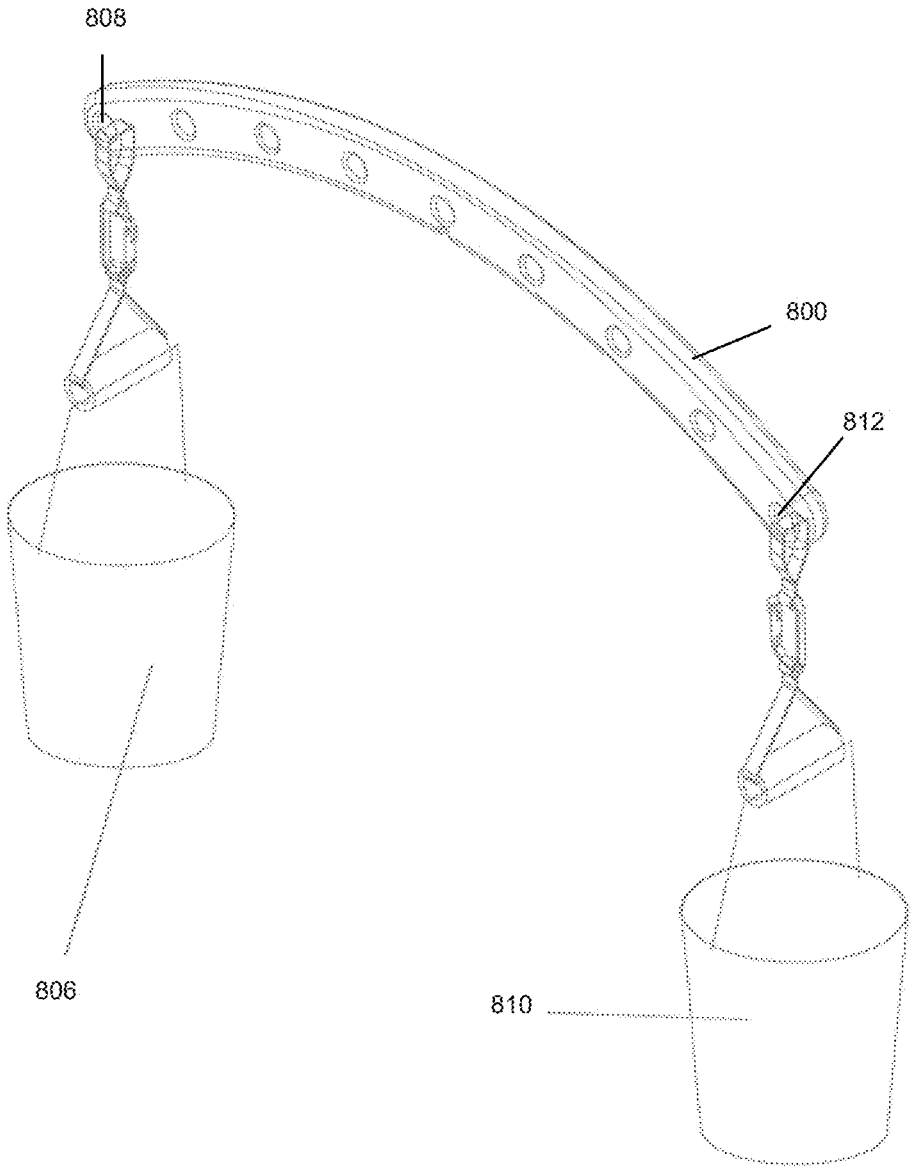
FIG. 25 is a schematic view of buckets attached to the workout device of FIG. 1.

As another example, FIG. 25 depicts workout device 800 where load 806 and load 810 are buckets and attached to workout device 800 with a combination of straps and carabiners.

Figure 26:
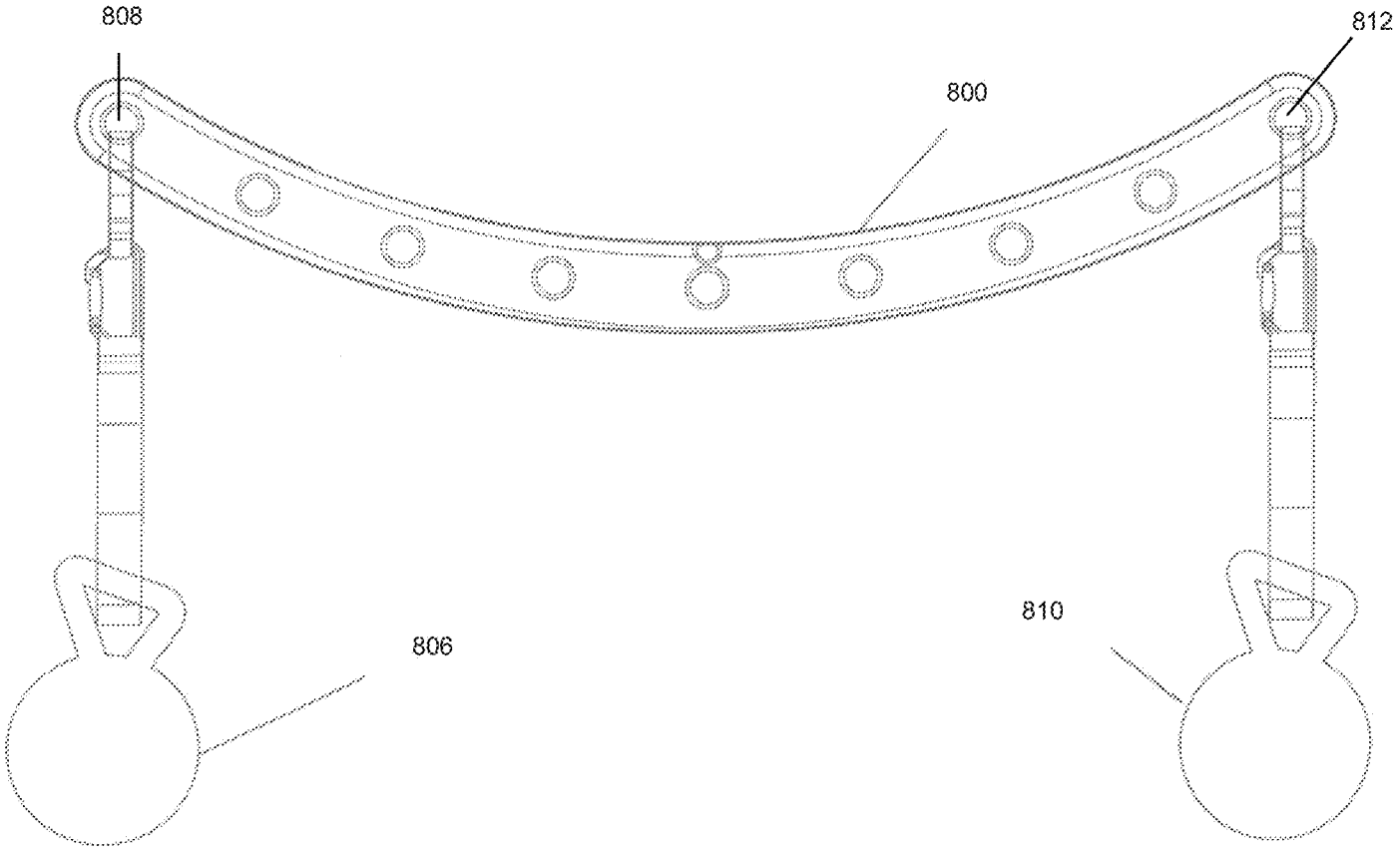
FIG. 26 is a schematic view of kettlebells attached to the workout device of FIG. 1 in inverted orientation.

As yet another example, FIG. 26 depicts an inverted workout device 800 where load 806 and load 810 are kettlebells and attached to workout device 800 with a combination of straps and carabiners.

As illustrated in FIG. 18 through FIG. 26, load 806 and load 810 may be applied to, attached, or hitched to workout device 800 symmetrically about the centre of workout device 800. In some embodiments, load 806 and or load 810 may be attached to workout device 800 asymmetrically about the centre of workout device 800. In some embodiments, workout device 800 may be loaded asymmetrically atop a supporting surface, such as a floor or the ground.

Figure 27:
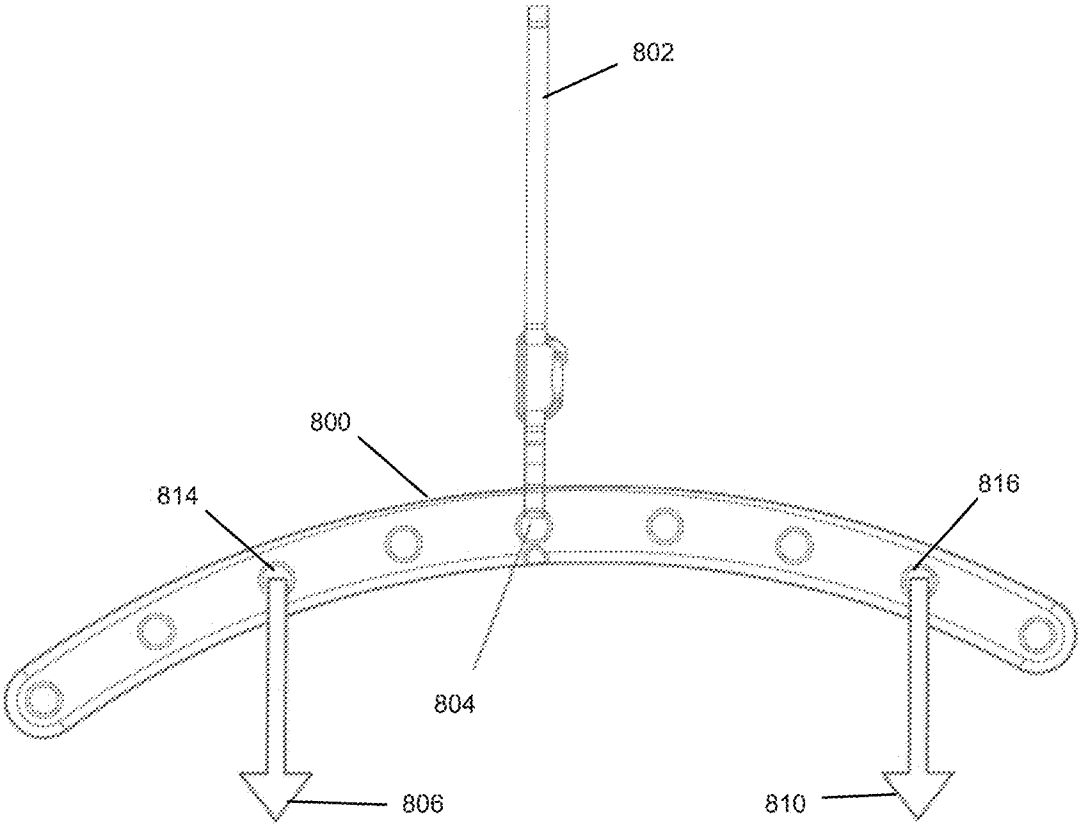
FIG. 27 is a schematic view of two loads applied asymmetrically to the workout device of FIG. 1 in suspension from a single centre attachment point.

For example, FIG. 27 depicts workout device 800 attached to anchor 802 at centre attachment point 804. Workout device 800 may be attached to anchor 802 at an attachment point other than at centre attachment point 804, or may be attached to more than one anchor at one or more attachment points, or may not be attached to any anchors. Load 806 is attached to workout device 800 with an appropriate attachment device at an attachment point 814, and load 810 is attached to workout device 800 with an appropriate attachment device at an attachment point 816.

As illustrated in FIG. 27, load 806 and load 810 are not at a distance equal to and opposite from centre attachment point 804, such that if load 806 and load 810 are the same, workout device 800 should act as an imbalanced lever.

In some embodiments, workout devices 100, 200, 300, 400, or 700 may be configured for lever training. A load may be attached to a workout device at an attachment point offset from the centre of the workout device, and one or more counter-loads may need to be applied to the workout device to balance the workout device. In this configuration, workout devices 100, 200, 300, 400, or 700 may or may not be attached to one or more anchors.

Figure 28:
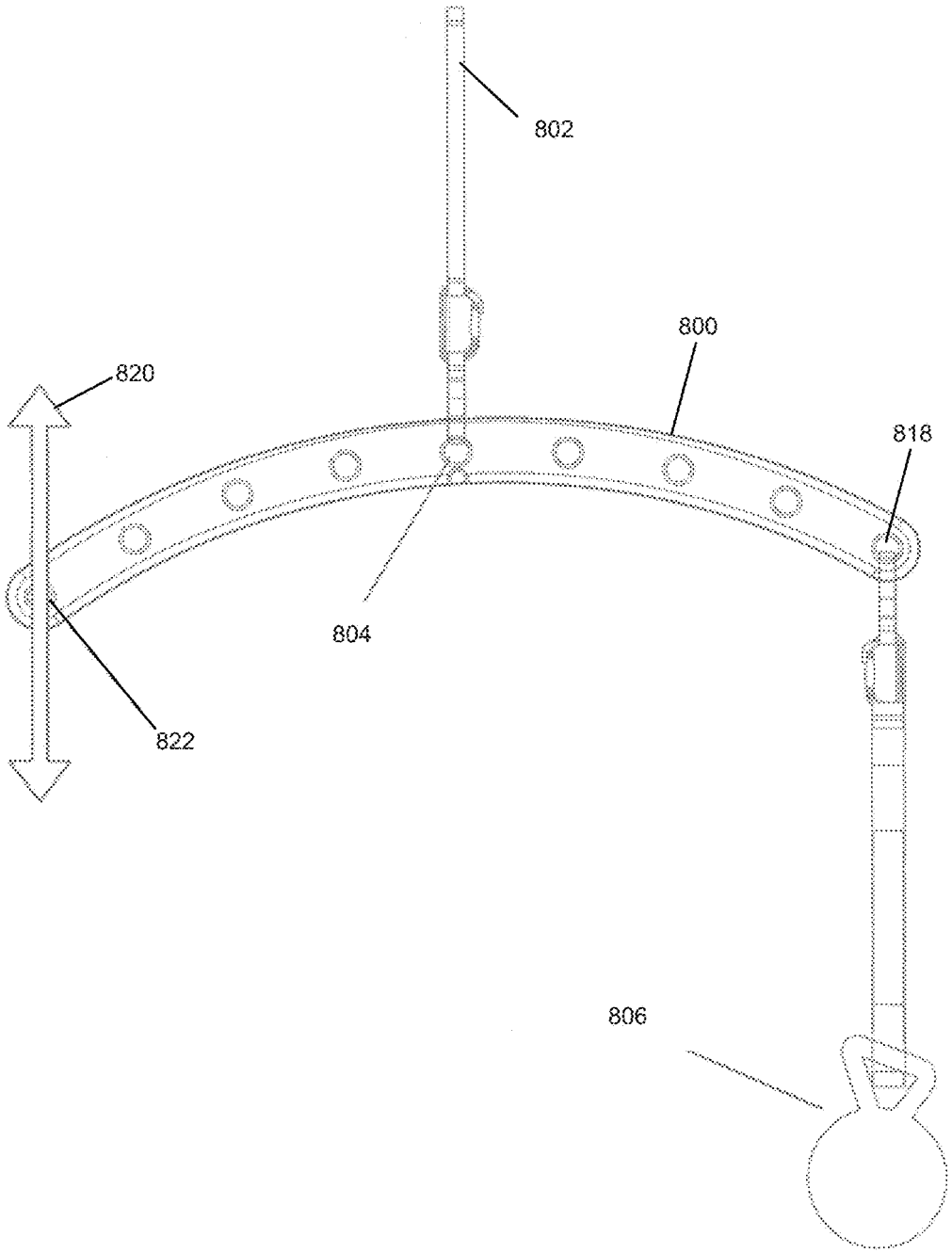
FIG. 28 is a schematic view of a kettlebell attached to a distal end of the workout device of FIG. 1 suspended from a single centre attachment point.

For example, FIG. 28 depicts workout device 800, generally similar to workout device 100, attached to anchor 802 at centre attachment point 804. Workout device 800 may be attached to anchor 802 at an attachment point other than at centre attachment point 804, or may be attached to more than one anchor at one or more attachment points, or may not be attached to any anchors. Load 806, depicted as a kettlebell, is attached to workout device 800 with an appropriate attachment device at an attachment point 818.

To balance workout device 800 as depicted in FIG. 28, a counter-load 820 may need to be applied. As illustrated, counter-load 820 may be applied at an attachment point 822 to balance workout device 800. If workout device 800 is not attached to anchor 802, one or more counter-loads 820 may need to be applied to workout device 800 to balance workout device 800.

Figure 29:
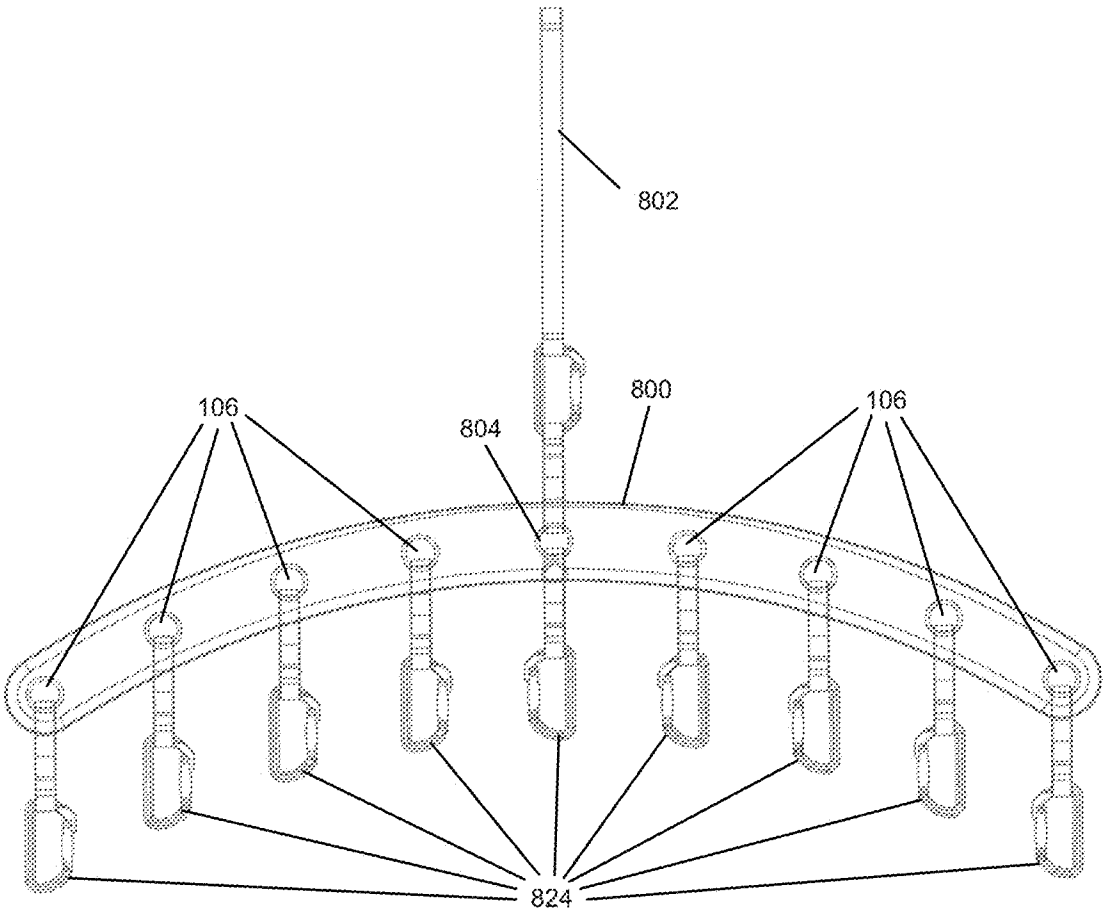
FIG. 29 is a schematic view of multiple loads attached to the workout device of FIG. 1.

In some embodiments, a plurality of loads may be attached to workout devices 100, 200, 300, 400 or 700. For example, FIG. 29 depicts workout device 800, generally similar to workout device 100, attached to anchor 802 at centre attachment point 804. Workout device 800 may be attached to anchor 802 at an attachment point other than at centre attachment point 804, or may be attached to more than one anchor at one or more attachment points, or may not be attached to any anchors. Loads 824 are attached to all attachment points 106 of workout device 800. Loads 824 may include appropriate attachment devices to attach additional loads, buckets, loading pins, Olympic weights, standard weights, kettlebells, bags, bladders, cinder blocks, a user, any other appropriate object, or any combination thereof.

As depicted in FIG. 29, a combination of straps and carabiners are attached to each attachment point 106 of workout device 800 to further attach additional loads.

Workout devices 100, 200, 300, 400, or 700 may be configured to be used to perform a plurality of exercises.

In some embodiments, workout devices 100, 200, 300, 400, or 700 may be used for suspension training. Workout devices 100, 200, 300, 400, or 700 may be attached to one or more anchors as depicted in FIG. 9 through FIG. 14, and one or more appropriate attachment devices, such as handles, may be attached to workout devices 100, 200, 300, 400, or 700, such that a user may perform exercises while engaged with the attachment devices.

Figure 30:
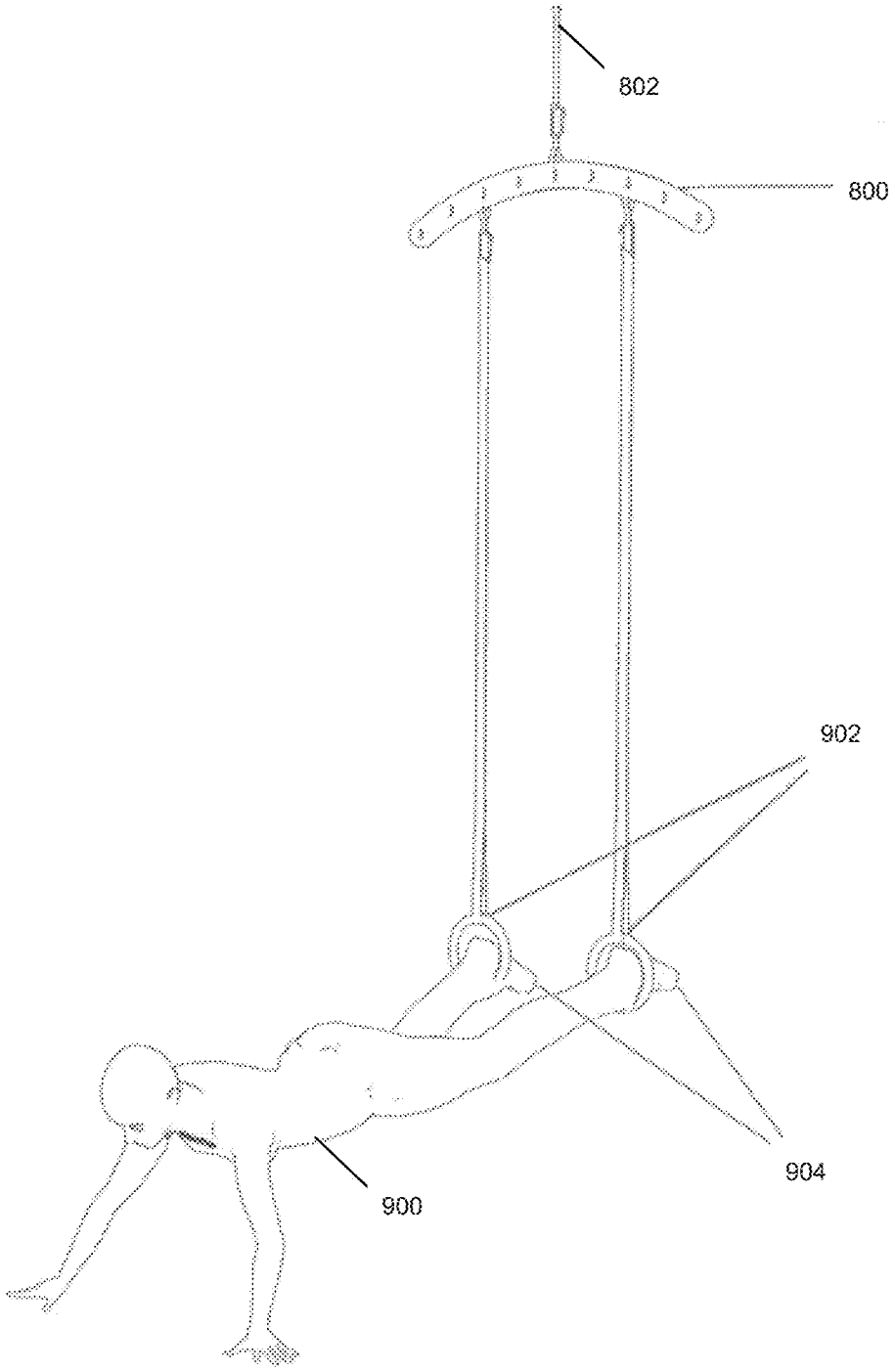
FIG. 30 is a perspective view of a user using the workout device of FIG. 1 for suspension training.
Figure 31:
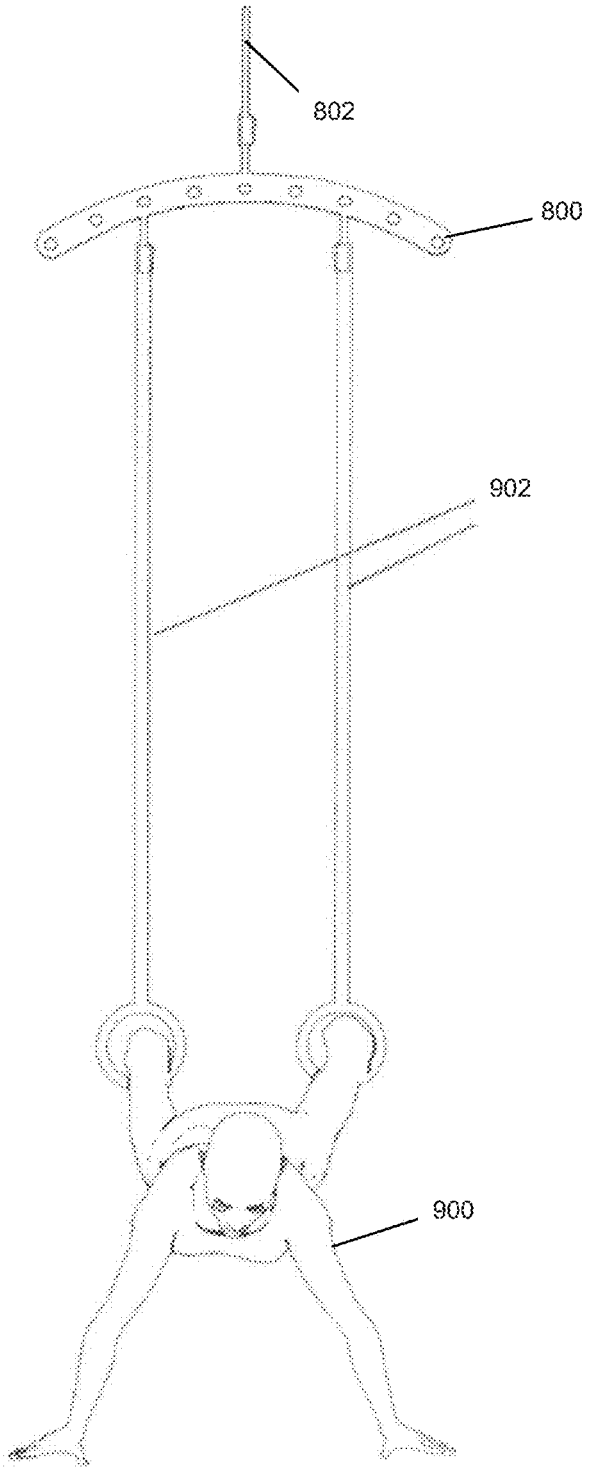
FIG. 31 is a front view of a user using the workout device of FIG. 1 for suspension training.

As an example, FIG. 30 and FIG. 31 depict workout device 800, generally similar to workout device 100, attached to anchor 802 at centre attachment point 804 and being used by a user 900. Workout device 800 may be attached to an attachment point other than centre attachment point 804. A pair of rings 902 are attached to workout device 800. Loads 904 may be further attached to rings 902. As depicted in FIG. 30 and FIG. 31, loads 904 are the legs of user 900. Loads 904 may be attached to workout device 800 symmetrically or asymmetrically. In this position, user 900 may, for example, perform suspended push ups, planks, or abdominal crunches.

As another example, workout device 800 may be attached to anchor 802 at an attachment point, such as centre attachment point 804. Loads 904 may be attached to workout device 800, such as weight plates. User 900 may be positioned below workout device 800 such that the level at which workout device 800 is suspended may correspond to the lowest point in a repetition of a bench press. As such, user 900 may perform a bench press exercise using workout device 800 suspended from anchor 802 without workout device 800 passing below the lowest point in a repetition of a bench press, which may improve safety for user 900 when exercising.

Figure 32:
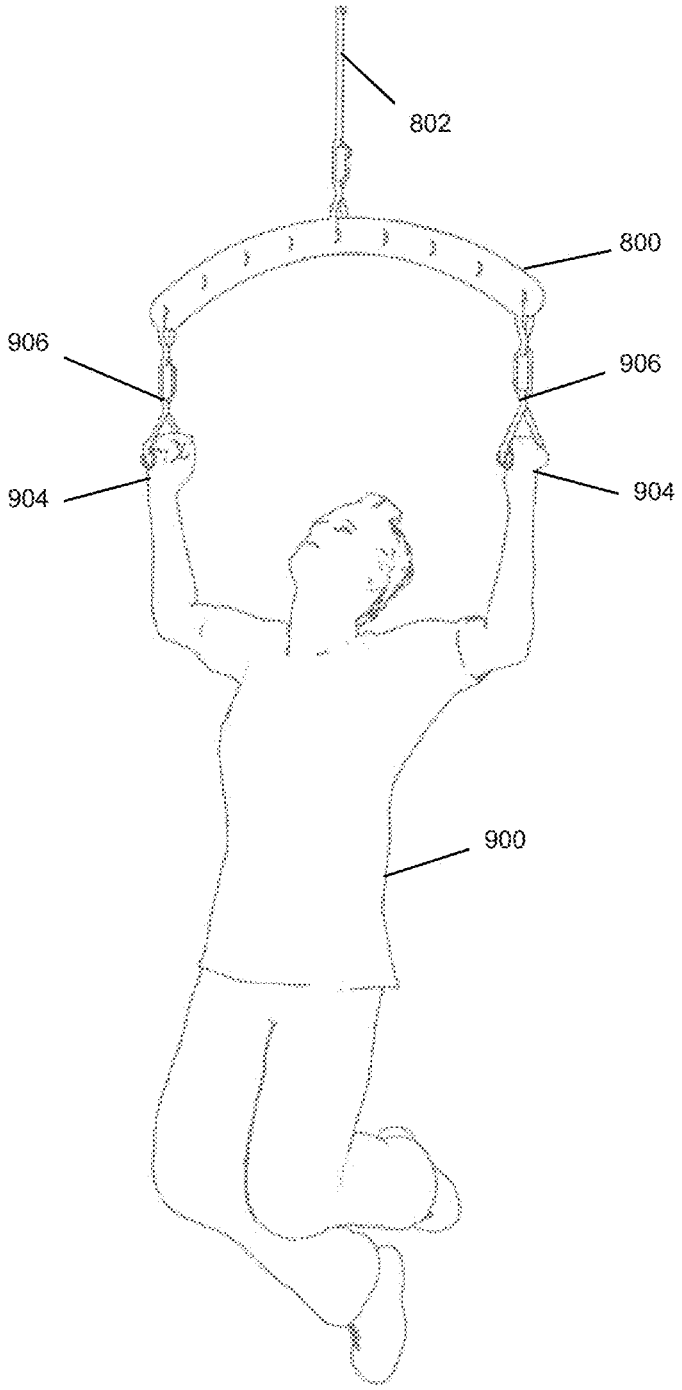
FIG. 32 is a perspective view of a user using the workout device of FIG. 1 to do pull ups.
Figure 33:
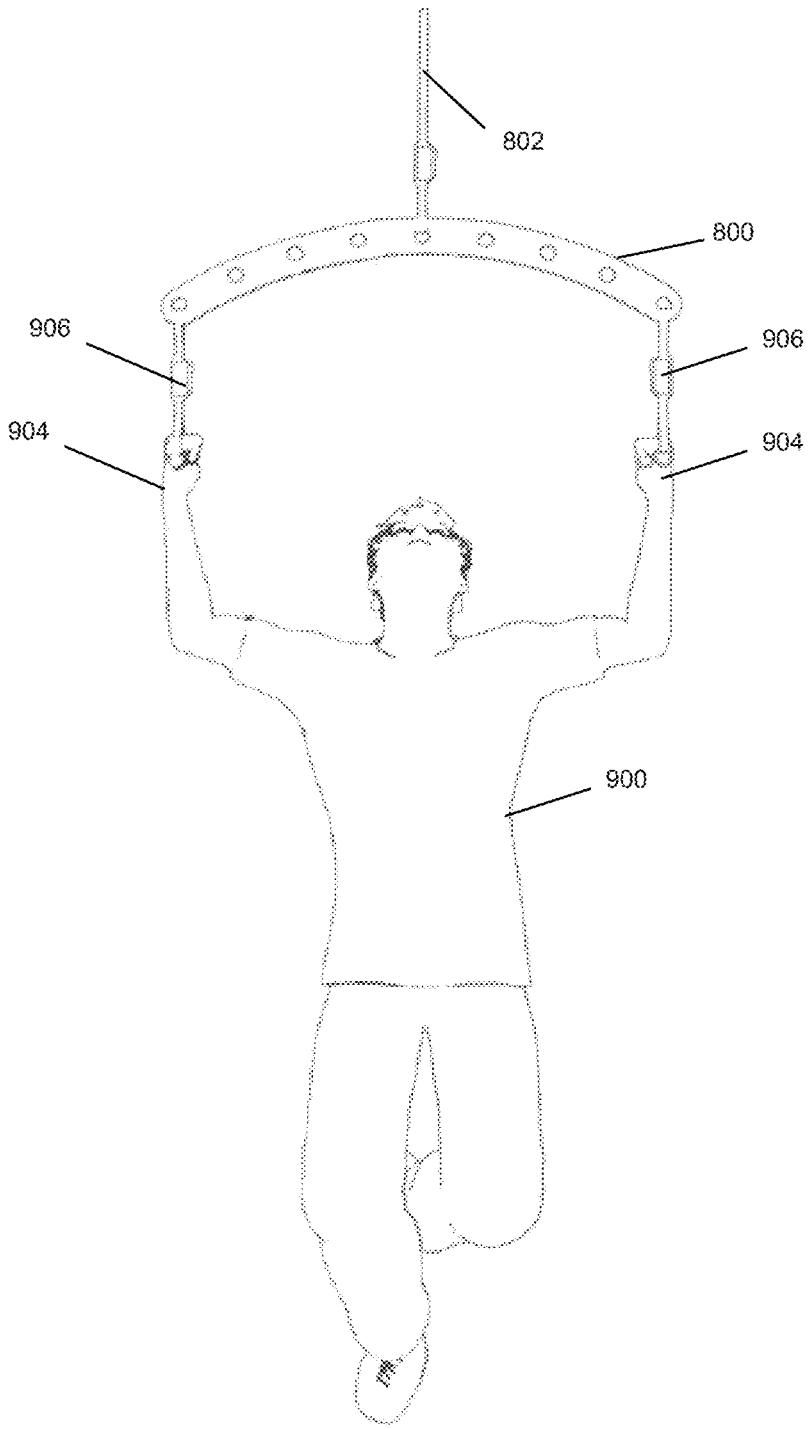
FIG. 33 is a front view of a user using the workout device of FIG. 1 to do pull ups.

As yet another example, as depicted in FIG. 32 and FIG. 33, two handles 906 are attached to workout device 800. Loads 904 may be further attached to handles 906. Loads 904 may be attached to workout device 800 symmetrically or asymmetrically. As illustrated in FIG. 32 and FIG. 33, loads 904 are the hands of user 900. User 900 may, as depicted, perform pull ups. In some embodiments, user 900 may perform symmetrical or asymmetrical pull ups.

In some embodiments, workout devices 100, 200, 300, 400, or 700 may be used as a bar for bar-based weight training.

For example, workout device 800, generally similar to workout device 100, may be configured as depicted in FIG. 22 through FIG. 26. User 900 may use workout device 800 as configured to perform exercises such as bent over rows, bar curls, shoulder presses, French curls, triceps extensions, and the like.

In some embodiments, workout devices 100, 200, 300, 400, or 700 may be used for lower body weight training.

Figure 34:
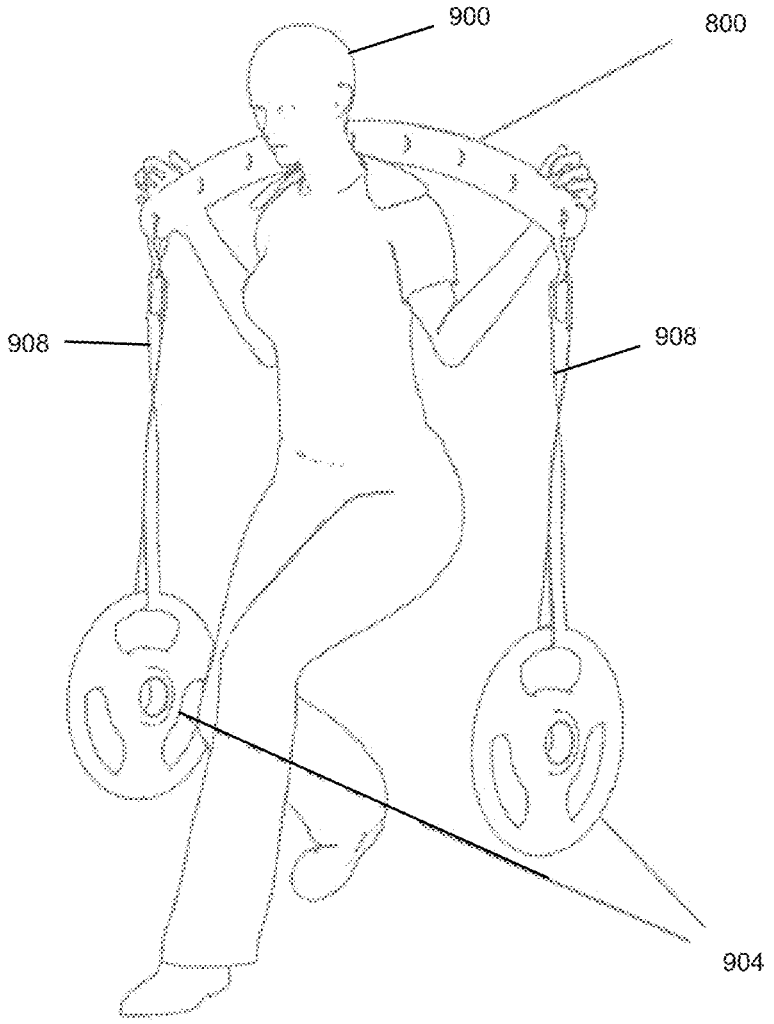
FIG. 34 is a perspective view of a user using the workout device of FIG. 1 to do lower body weight training.
Figure 35:
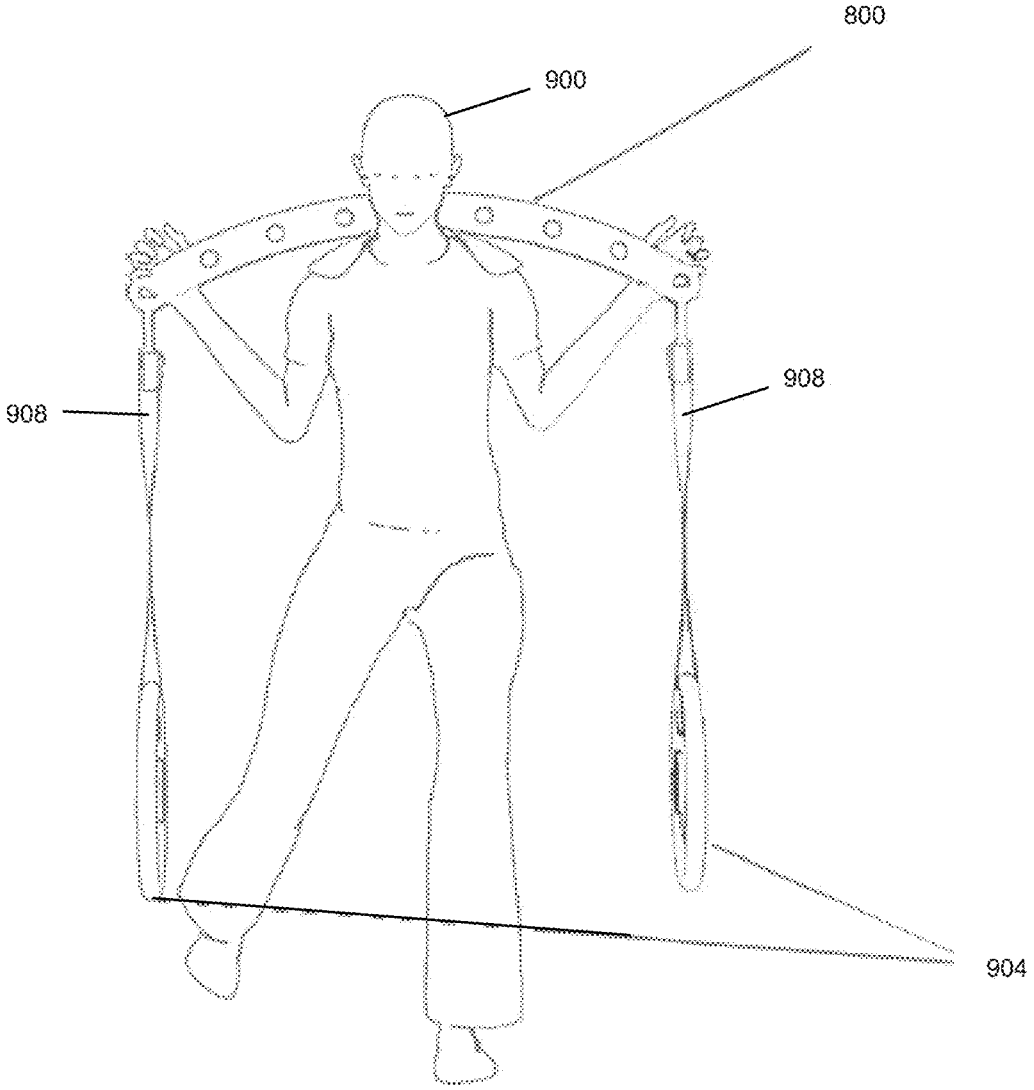
FIG. 35 is a front view of a user using the workout device of FIG. 1 to do lower body weight training.

For example, workout device 800, generally similar to workout device 100, may be laid across the upper back and/or shoulders of user 900 as depicted in FIG. 34 and FIG. 35. Cervical notch 110 and trapezius cradle 416 may accommodate the cervical spine and upper back of user 900 for better distribution of weight of workout device 800 on user 900. As depicted in FIG. 34 and FIG. 35, two straps 908 are attached to workout device 800. Loads 904 may be further attached to straps 908. As illustrated in FIG. 34 and FIG. 35, loads 904 are weight plates. Loads 904 may be attached to workout device 800 symmetrically or asymmetrically. User 900 may, as depicted, perform squats. User 900 may also perform yoke walks, lunges, and the like.

In some embodiments, workout devices 100, 200, 300, 400, or 700 may be used atop a supporting surface to perform exercises.

Figure 36:
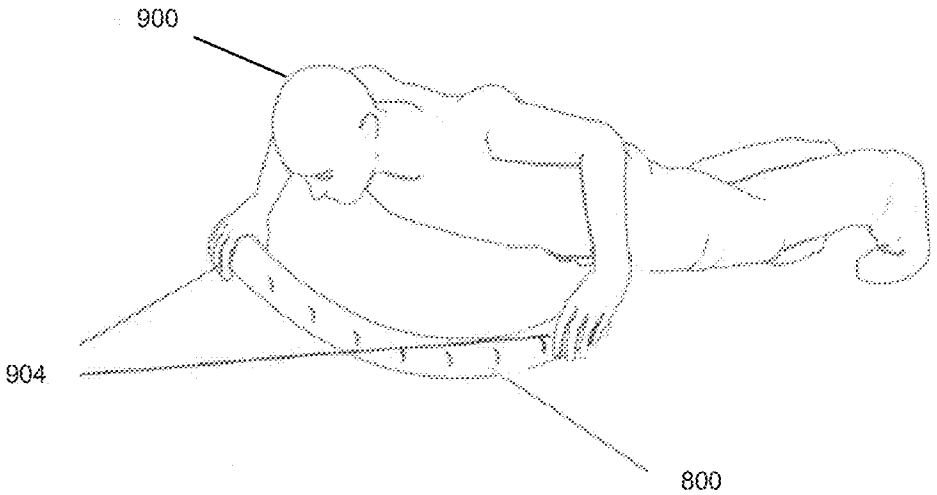
FIG. 36 is a perspective view of a user using the workout device of FIG. 1 to do push ups.
Figure 37:
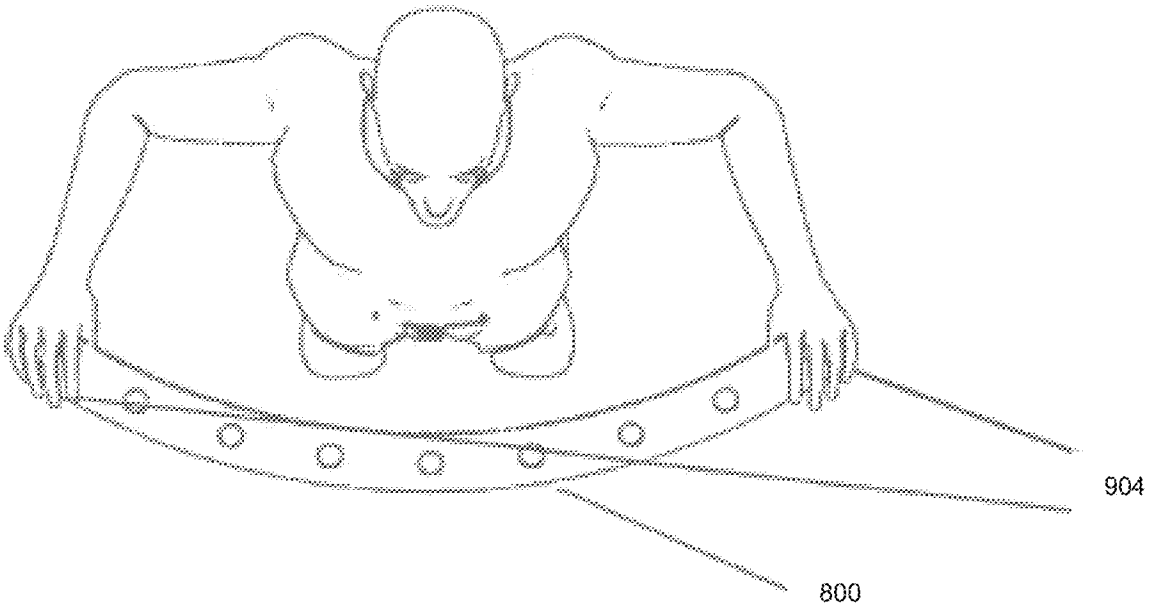
FIG. 37 is a front view of a user using the workout device of FIG. 1 to do push ups.

For example, workout device 800, generally similar to workout device 100, may be placed on a supporting surface, such as a floor or the ground, in an inverted position such that workout device 800 contacts the ground at one point, as depicted in FIG. 36 and FIG. 37. Loads 904 may be applied to workout device 800. As illustrated in FIG. 36 and FIG. 37, loads 904 are the hands of user 900. Loads 904 may be applied to workout device 800 symmetrically or asymmetrically. User 900 may, as depicted, perform push ups while holding onto workout device 800.

In some embodiments, workout devices 100, 200, 300, 400, or 700 may be suspended using one or more anchors attached to one or more attachment points, may be mounted onto a wall with appropriate fasteners such as screws, or inserted through dowels or rods that are mounted on a wall for simulating a climbing wall or for providing grip positions, such as at crimp hold 404, hand grips 406, two-finger pocket holds 408, or three-finger pocket holds 410 as depicted in FIG. 7 and FIG. 8, to perform grip exercises.

In some embodiments, workout devices 100, 200, 300, 400, or 700 may be configured into parallette 700 as depicted in FIG. 15, FIG. 16, and FIG. 17 to perform exercises.

Figure 38:
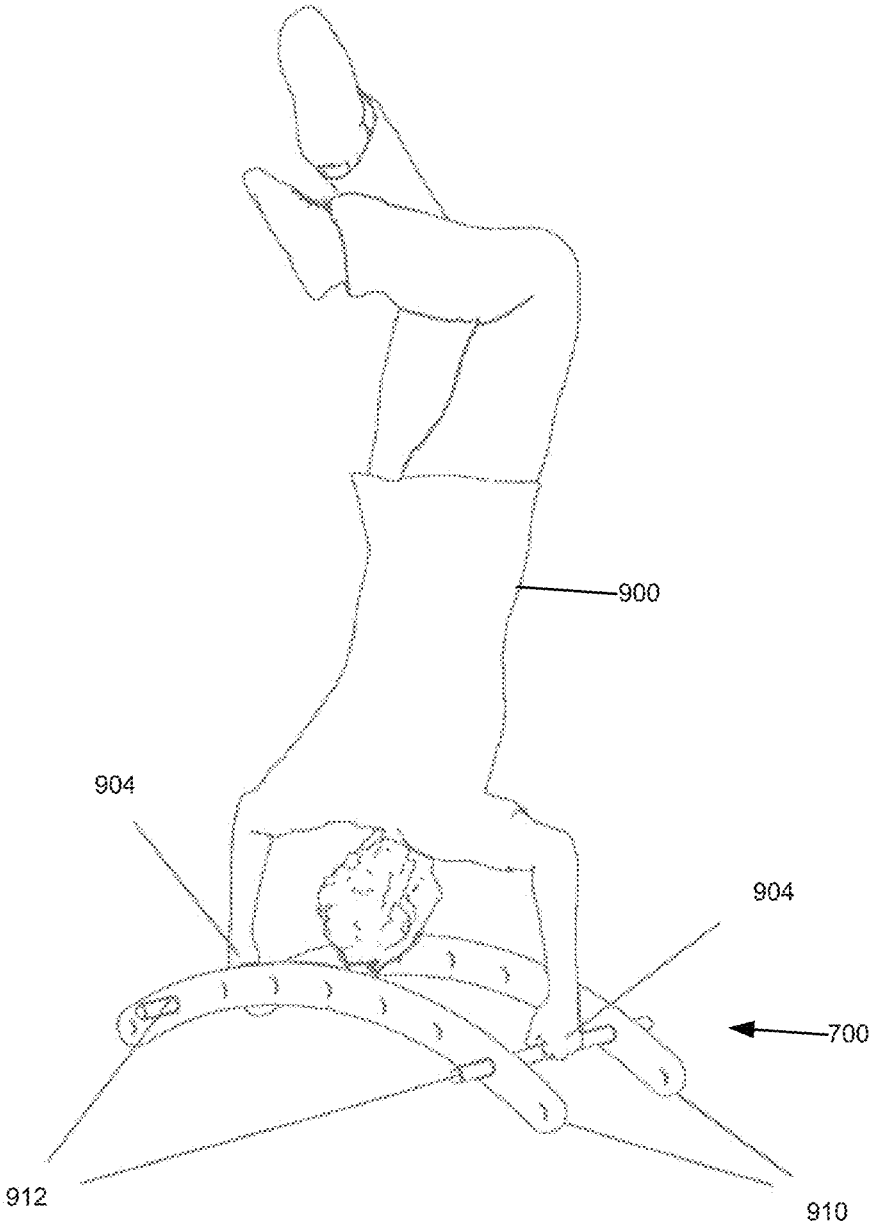
FIG. 38 is a perspective view of a user using the workout device of FIG. 1 configured as the parallette of FIG. 15 to do handstand push ups.
Figure 39:
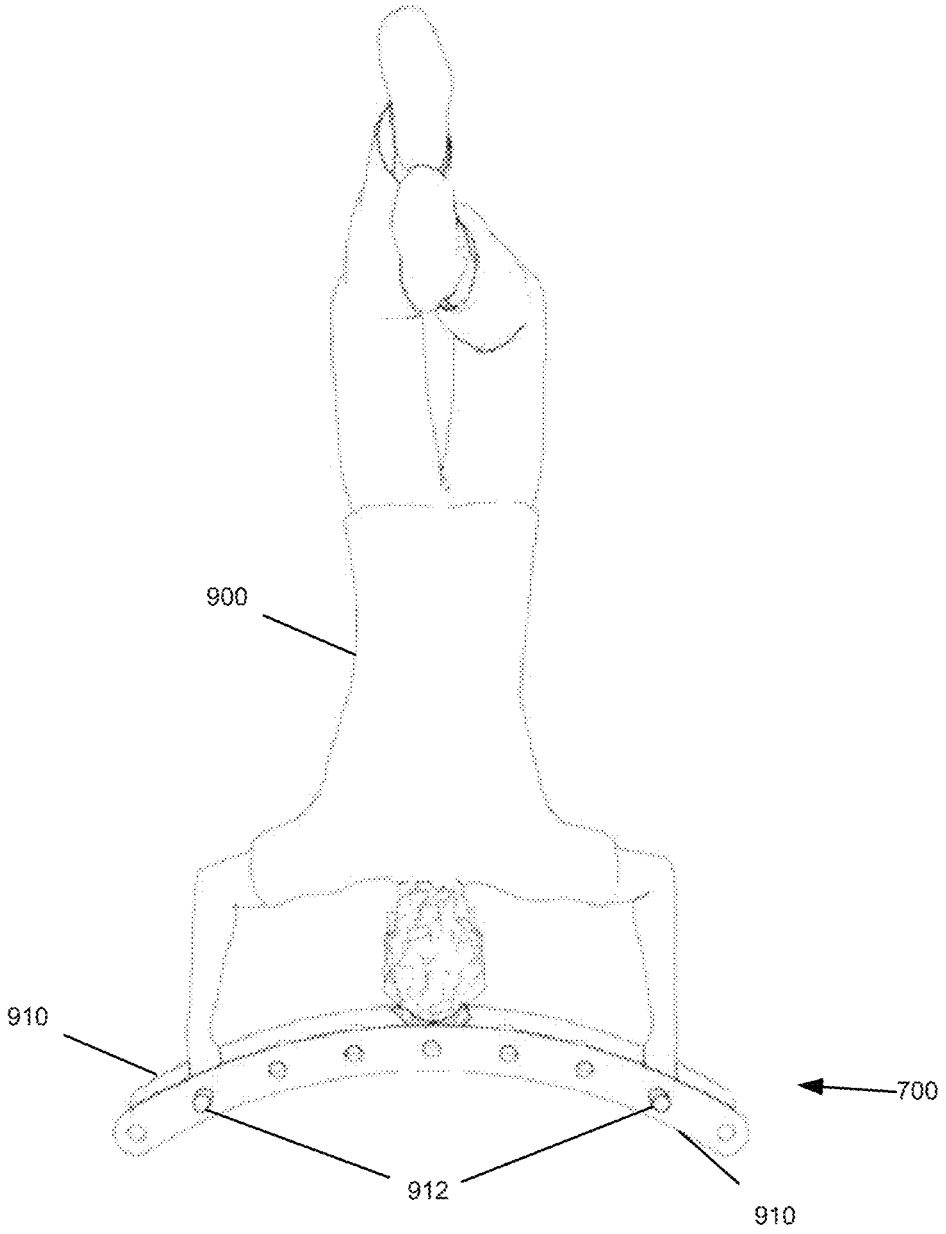
FIG. 39 is a front view of a user using the workout device of FIG. 1 configured as the parallette of FIG. 15 to do handstand push ups.

For example, as illustrated in FIG. 38 and FIG. 39, two workout devices 910, generally similar to workout device 100, may be assembled into parallette 700 using two crossbars 912. Crossbars 912 may be secured to working devices 910 using appropriate fastening devices, such as cotter pins. Loads 904 may be applied to crossbars 912. As shown in FIG. 38 and FIG. 39, loads 904 are the hands of user 900. User 900 may, as depicted, perform handstand push ups while holding onto crossbars 912. User 900 may also do exercises such as push ups, handstands, dips, and the like.

As another example, parallette 700 may be attached to one or more anchors at one or more attachment points and may be suspended, which may be used as dynamic monkey bars.

In some embodiments, workout devices 100, 200, 300, 400, or 700 may be configured as a lever in a manner similar to the configuration as illustrated in FIG. 28 to perform exercises.

For example, as shown in FIG. 28, workout device 800, generally similar to workout device 100, may be attached to anchor 802 at centre attachment point 804. Workout device 800 may be attached to anchor 802 at an attachment point other than at centre attachment point 804, or may be attached to more than one anchor at one or more attachment points, or may not be attached to any anchors. Load 806, depicted as a kettlebell, is attached to workout device 800 with an appropriate attachment device at attachment point 818. When loaded in this manner, workout device 800 may behave as an imbalanced lever.

To balance workout device 800 as depicted in FIG. 28, counter-load 820 may need to be applied, for example, by user 900. As illustrated, counter-load 820 may be applied at an attachment point 822 to balance workout device 800. If workout device 800 is not attached to anchor 802, one or more counter-loads 820 may need to be applied to workout device 800 by user 900 to balance workout device 800. User 900 may both push and pull workout device 800 when configured as a lever to balance workout device 800. The amount that user 900 may have to push and/or pull workout device 800 configured as a lever may vary based on the location on workout device 800 at which user 900 pushes and/or pulls.

Workout device 800 may be used as a lever to perform exercises either when attached to one or more anchors or not attached to any anchors. User 900 may, for example, perform triceps extensions and curls.

When using workout device 100, 200, 300, 400, or 700 to perform exercises, instability may be introduced, whether workout device 100, 200, 300, 400, or 700 is suspended at one or more points, not suspended, loaded with one or more loads, or not loaded. This instability may cause certain muscles, such as muscles in the core or muscles located at certain joints or stability muscles, of a user to be engaged to stabilize the user. To overcome the instability introduced when performing exercises with workout device 100, 200, 300, 400, or 700, the user may engage multiple muscle groups and may engage muscles related to the normal and subconscious process of establishing, restoring, and maintaining balance, which may not be engaged when performing exercises without a factor of introduced instability. For example, exercising using workout device 100, 200, 300, 400, or 700 may challenge the user's relative body strength, such as the user's handedness. If a right-handed user is performing a push up using workout device 100, 200, 300, 400, or 700 as shown in FIG. 37, the user may naturally tend to fall towards the right since the user may be pushing down harder on workout device 100, 200, 300, 400, or 700 from the user's right hand. If the user begins to fall, the user's body may be alerted of the instability and engage the muscles necessary to correct the imbalance. The user's body may instinctively engage the muscles to stabilize the user. Exercising with workout device 100, 200, 300, 400, or 700 may challenge the user's whole body to participate in order to maintain correct posture and balance, and to perform dynamic exercise movement.

When using workout device 100, 200, 300, 400, or 700 to perform exercises, workout device 100, 200, 300, 400, or 700 may be able to move laterally along the X-, Y-, and Z-axes, rotate about the X-, Y-, and Z-axes, or any combination thereof, as shown in FIG. 1. This may introduce additional instability when exercising. The arced shape of workout device 100, 200, 300, 400, or 700 may enhance the amount of movement and/or rotation and instability introduced when exercising with workout device 100, 200, 300, 400, or 700. Workout devices 100, 200, 300, or 400 may generate multidimensional forces along the X-, Y-, and/or Z-axes and/or generate multidimensional moments about the X-, Y-, and/or Z-axes when loaded. These multidimensional forces and/or moments may be generated while workout devices 100, 200, 300, 400, or 700 may be suspended from a support or while atop a supporting surface, such as a floor or the ground.

Workout device 100, 200, 300, 400, or 700 may be a versatile device that may be used for a variety of types of exercises. For example, workout device 100, 200, 300, 400, or 700 may be used for suspension-based weight training, for example, as shown in FIG. 30 through FIG. 33. Workout device 100, 200, 300, 400, or 700 may be used for bar-based weight training, for example, as shown in FIG. 22 through FIG. 26. Workout device 100, 200, 300, 400, or 700 may be used for lower body weight training, for example, as shown in FIG. 34 and FIG. 35. Workout device 100, 200, 300, 400, or 700 may also be used on the ground, for example, as shown in FIG. 36 and FIG. 37, or as a parallette, as shown in FIG. 38 and FIG. 39.

Workout device 100, 200, 300, 400, or 700 may comprise a plurality of attachment points 106. By attaching one or more anchors and/or attaching one or more loads to attachment points 106 located along workout device 100, 200, 300, 400, or 700, the user may change the distance between the load and the point or points about which workout device 100, 200, 300, 400, or 700 are supported. By changing the distance between the load and the point or points of support, the user may vary their exercise experience proportional to their movement towards or away from the point or points about which workout device 100, 200, 300, 400, or 700 are supported.

As illustrated in FIG. 29, workout device 100, 200, 300, 400, or 700 may accommodate multiple loads, for example, by loading onto more than one attachment point 106. Since multiple attachment or hitching options may be appropriate, such as wide-gait carabiners, climbing slings, cables, ropes, chains, cam-buckle straps, elastic bands, rubber bands, and the like, multiple loads may also be considered appropriate, such as kettlebells, loading pins with traditional Olympic weights, and bags, bladders, or buckets filled with various solid and liquid materials.

The appropriate attachment devices to attach loads to workout device 100, 200, 300, 400, or 700, such as a combination of straps and carabiners, elastic bands, or rubber bands, may be dynamic, which may introduce instability by varying the center of mass of workout device 100, 200, 300, 400, or 700 and the attached load as/while the load is attached to the attachment device.

The loads themselves may be dynamic, such as liquid weight sources like water held in a bucket. The movement of the loads may also vary the center of mass of workout device 100, 200, 300, 400, or 700 and the load.

The dynamic nature of the attachment devices and/or the attached loads may introduce pendular training when a user is using workout device 100, 200, 300, 400, or 700 to exercise. The forces applied to workout device 100, 200, 300, 400, or 700 when attached with dynamic attachment devices and/or dynamic loads may be pendular such that the center of mass of workout devices 100, 200, 300, 400, or 700 may vary. Pendular training may require a user to overcome the instability introduced by the dynamic nature of the attachment devices and/or the attached loads.

Figure 40:
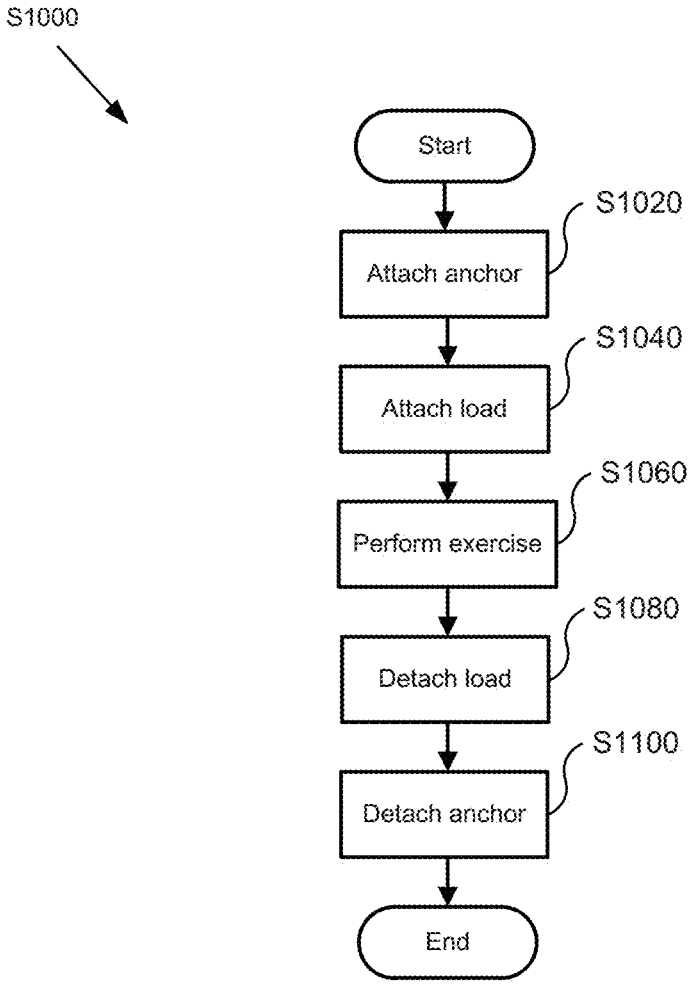
FIG. 40 is a flow chart depicting a method of using a workout device.

FIG. 40 depicts a method S1000 of using workout devices 100, 200, 300, 400, or 700.

At block S1020, workout devices 100, 200, 300, 400, or 700 may be attached to one or more anchors at one or more attachment points 106.

At block S1040, workout devices 100, 200, 300, 400, or 700 may be attached to one or more loads at one more attachment points 106. Appropriate attachment devices may be attached to workout devices 100, 200, 300, 400, or 700 in order to attach one or more loads to workout devices 100, 200, 300, 400, or 700.

At block S1060, a user may perform appropriate exercises based on whether workout devices 100, 200, 300, 400, or 700 is attached to anchors and based on the amount and types of loads that may be attached.

At block S1080, the attached loads may be detached from workout devices 100, 200, 300, 400, or 700.

At block S1100, the attached anchors may be detached from workout devices 100, 200, 300, 400, or 700.

As described above, workout devices 100, 200, 300, and 400 may have a generally arced shape with attachment points 106 internal to workout devices 100, 200, 300, and 400. Workout devices 100, 200, 300, or 400 may include one or more openings and/or channels that may be configured to provide a plurality of grip positions, such as those illustrated, for example, in FIG. 7 and FIG. 8.

Figure 41:
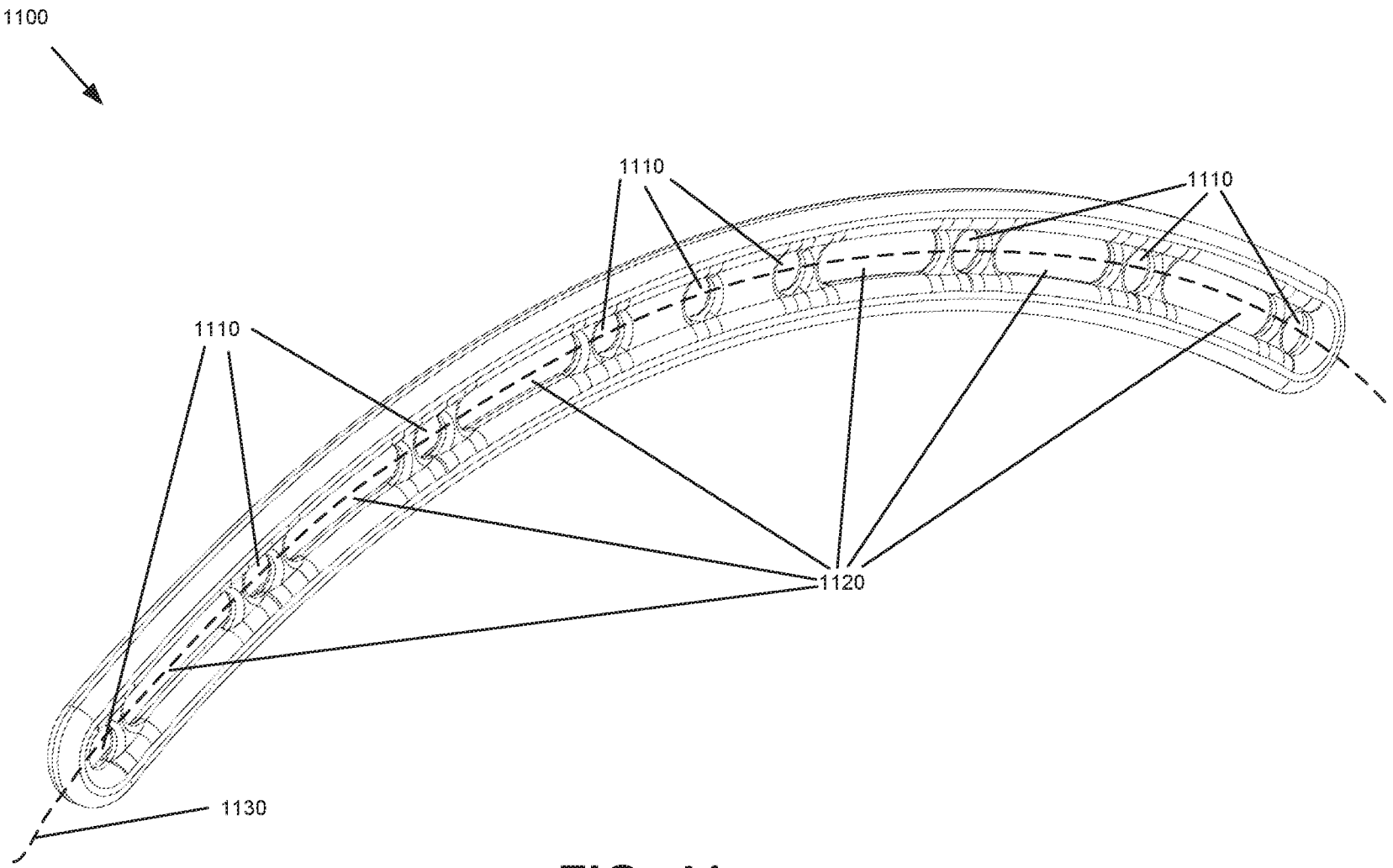
FIG. 41 is a perspective view of another workout device.

Other shapes and configurations are possible. For example, workout devices 100, 200, 300, or 400 may have a generally arced shape where attachment points 106 and openings and/or channels for grip positions may align generally along the shape of workout devices 100, 200, 300, or 400. FIG. 41 depicts a workout device 1100 with a generally arced shape similar to workout devices 100, 200, 300, or 400. Workout device 1100 may comprise a plurality of attachment points 1110 and a plurality of handholds 1120 along an axis 1130. Attachment points 1110 may be generally similar to attachment points 106 as described herein. Handholds 1120 may be positioned between attachment points 1110. Handholds 1120 may allow a user to hold or grip workout device 1100 with one or more hands and/or one or more fingers. As depicted, handholds 1120 may extend through workout device 1100, or handholds 1120 may not extend through workout device 1100. Axis 1130 may run along workout device 1100 and may intersect attachment points 1110 and handholds 1120. In some embodiments, axis 1130 may be the neutral axis of workout device 1100.

As described above, the attachment points of workout devices 100, 200, 300, and 400 may be sized to accommodate a standard dowel or rod, such that the attachment points may have a round shape.

Figure 42:
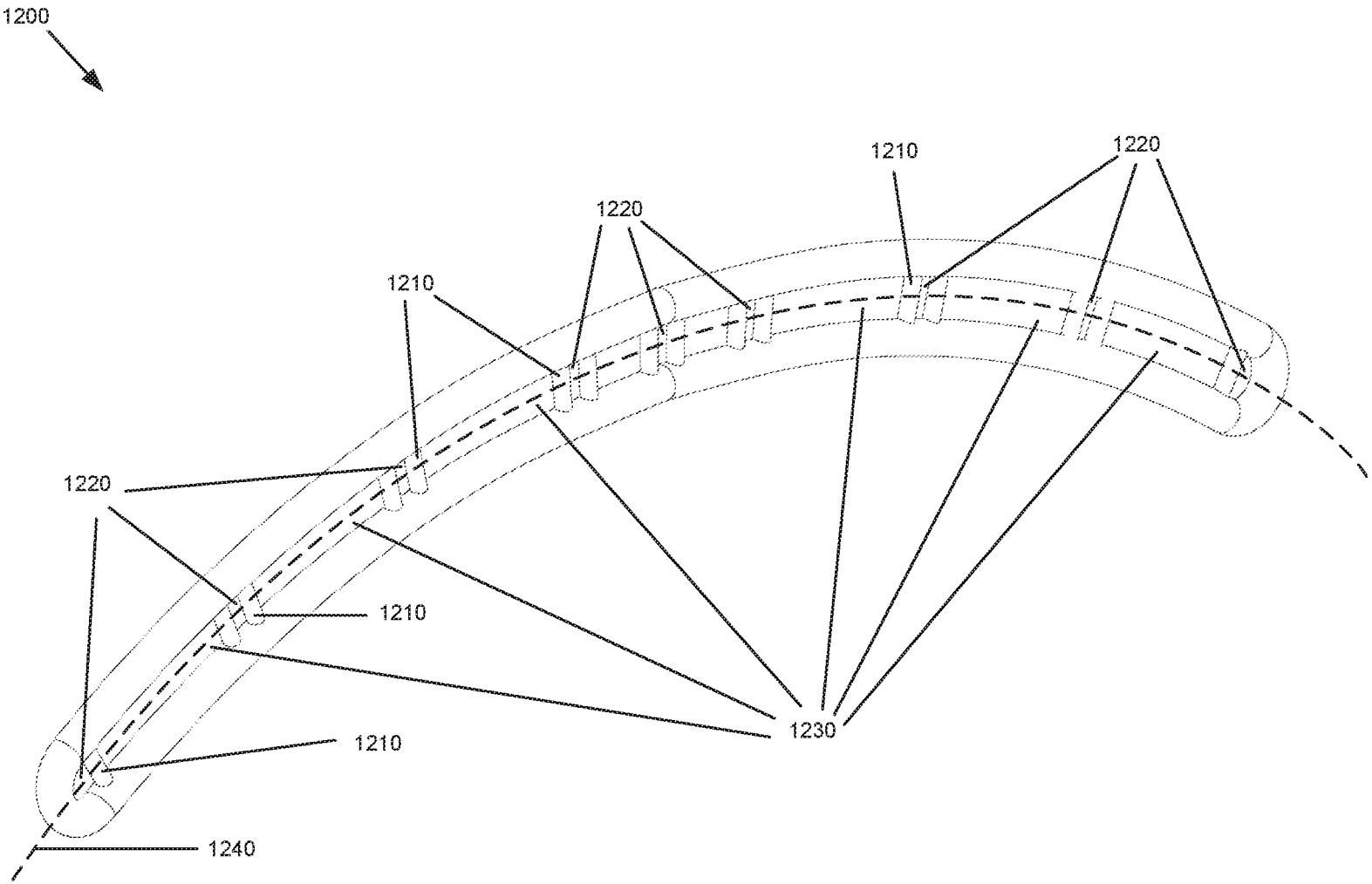
FIG. 42 is a perspective view of another workout device.

Other shapes of attachment points 106 are possible. It may be possible for the attachment points to have other shapes. For example, workout devices 100, 200, 300, or 400 may have a generally arced shape where attachment points 106 may not be round. FIG. 42 depicts a workout device 1200 comprising a generally hollow interior such that a user may put their hand through workout device 1200. A plurality of bars 1210 may define a plurality of attachment points 1220 and handholds 1230 along an axis 1240, similar to workout device 1100. Attachment points 1220 may be generally similar to attachment points 106 as described herein. Attachment points 1220 may be used to attach appropriate attachment devices and loads, and may be sized to accommodate standard dowels and rods, and may lack a generally round shape. Handholds 1230 may allow a user to hold or grip workout device 1100 with one or more hands and/or one or more fingers. Axis 1240 may run along workout device 1200 and may intersect attachment points 1210 and handholds 1230. In some embodiments, axis 1240 may be the neutral axis of workout device 1200.

As described above, workout devices 100, 200, 300, and 400 may have a generally arced shape with a generally rectangular cross-section with bevelled, rounded, chamfered, or otherwise smoothed edges, as shown in FIG. 1 through FIG. 3.

Figure 43:
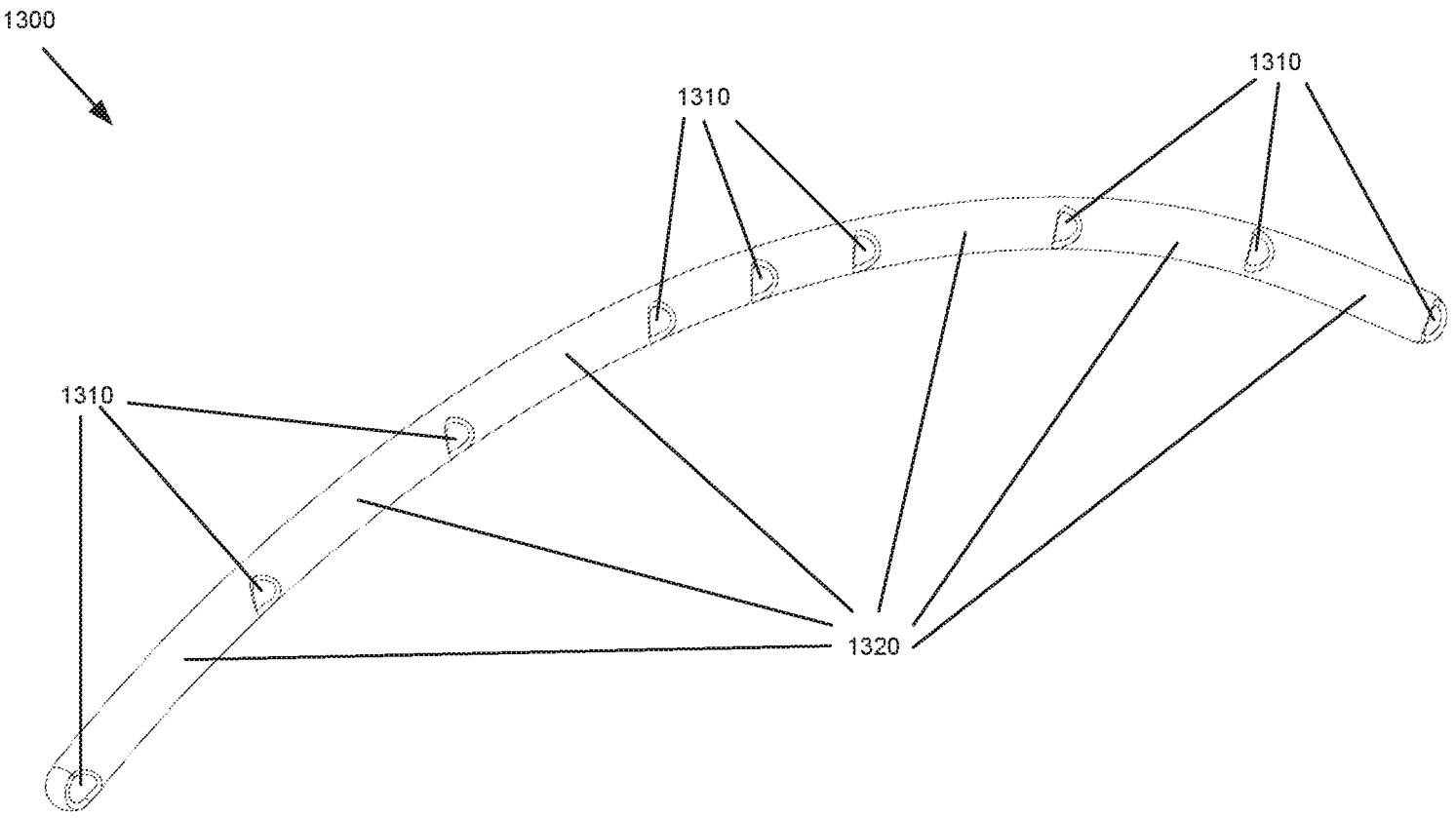
FIG. 43 is a perspective view of another workout device.

Other cross-sectional configurations are possible. For example, workout devices 100, 200, 300, or 400 may have a generally arced shape with a generally tubular cross-section. FIG. 43 depicts a workout device 1300 with a generally arced shape with a generally tubular cross-section. Workout device 1300 may have a plurality of attachment points 1310 along workout device 1300. The cross-sectional diameter of workout device 1300 may be larger than the diameter of attachment points 1310 such that workout device 1300 is a solid, uniform, and fully integrated device. Two adjacent attachment points 1310 may define a handhold 1320 for a user to hold or grip workout device 1300.

As described above, workout devices 100, 200, 300, and 400 may have a generally arced shape with attachment points 106 internal to workout devices 100, 200, 300, and 400.

Figure 44:
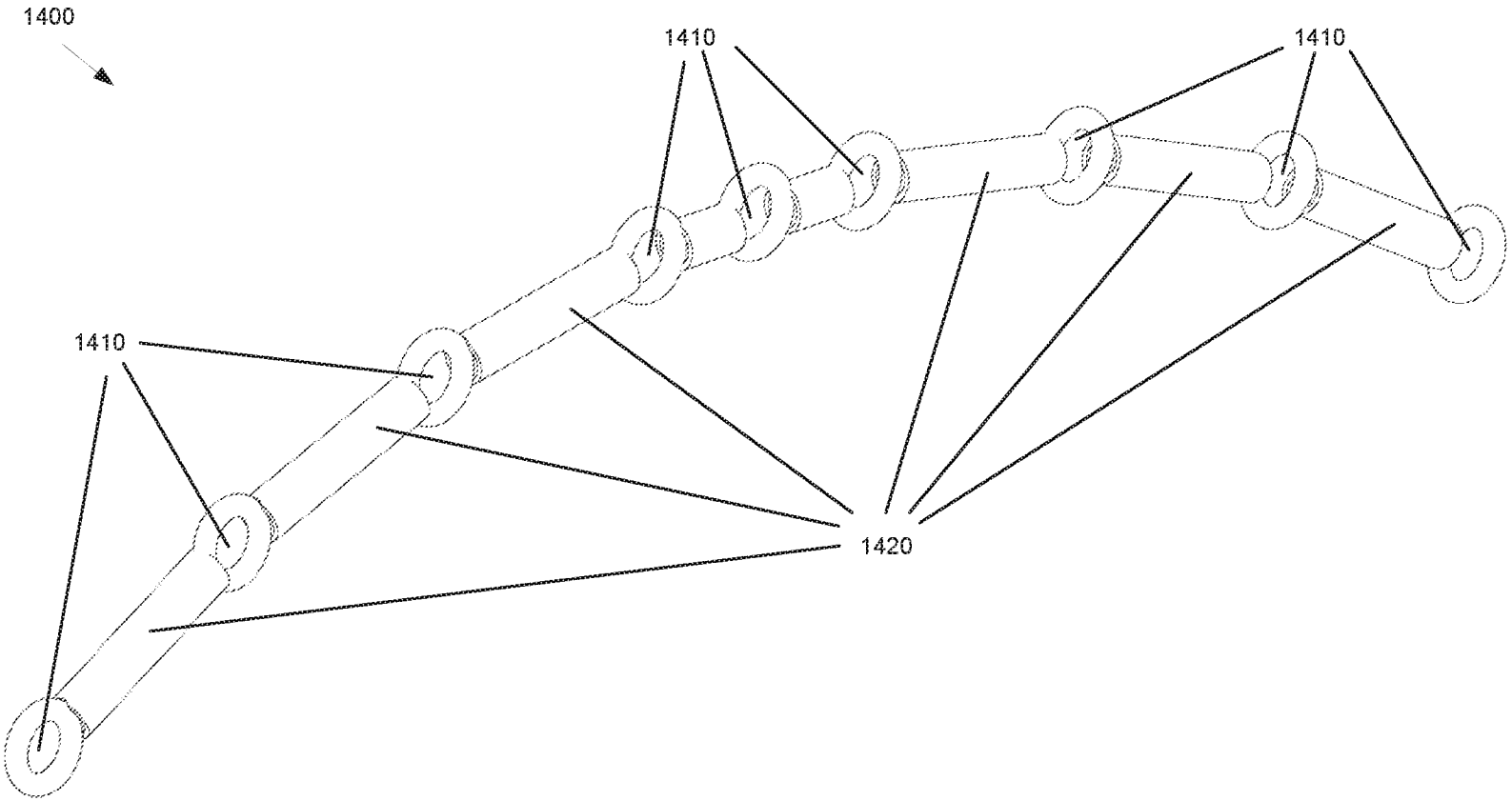
FIG. 44 is a perspective view of another workout device.

Other configurations of attachment points 106 are possible. It may be possible for attachment points 106 to not be internal to workout devices 100, 200, 300, and 400. FIG. 44 depicts a workout device 1400 that may comprise a plurality of attachment points 1410 and a plurality of handholds 1420. Attachment points 1410 may be may be used to attach appropriate attachment devices and loads, and may be sized to accommodate standard dowels and rods. Handholds 1420 may be between attachment points 1410. Handholds 1420 may allow a user to hold or grip workout device 1400 with one or more hands and/or one or more fingers. Workout device 1400 may be manufactured by fastening attachment points 1410 and handholds 1420 using appropriate fasteners, such as clips, screws, adhesives, or by welding. As depicted, attachment points 1410 is not internal to workout device 1400.

As described above, workout devices 100, 200, 300, and 400 may have a generally arced shape.

Figure 45:
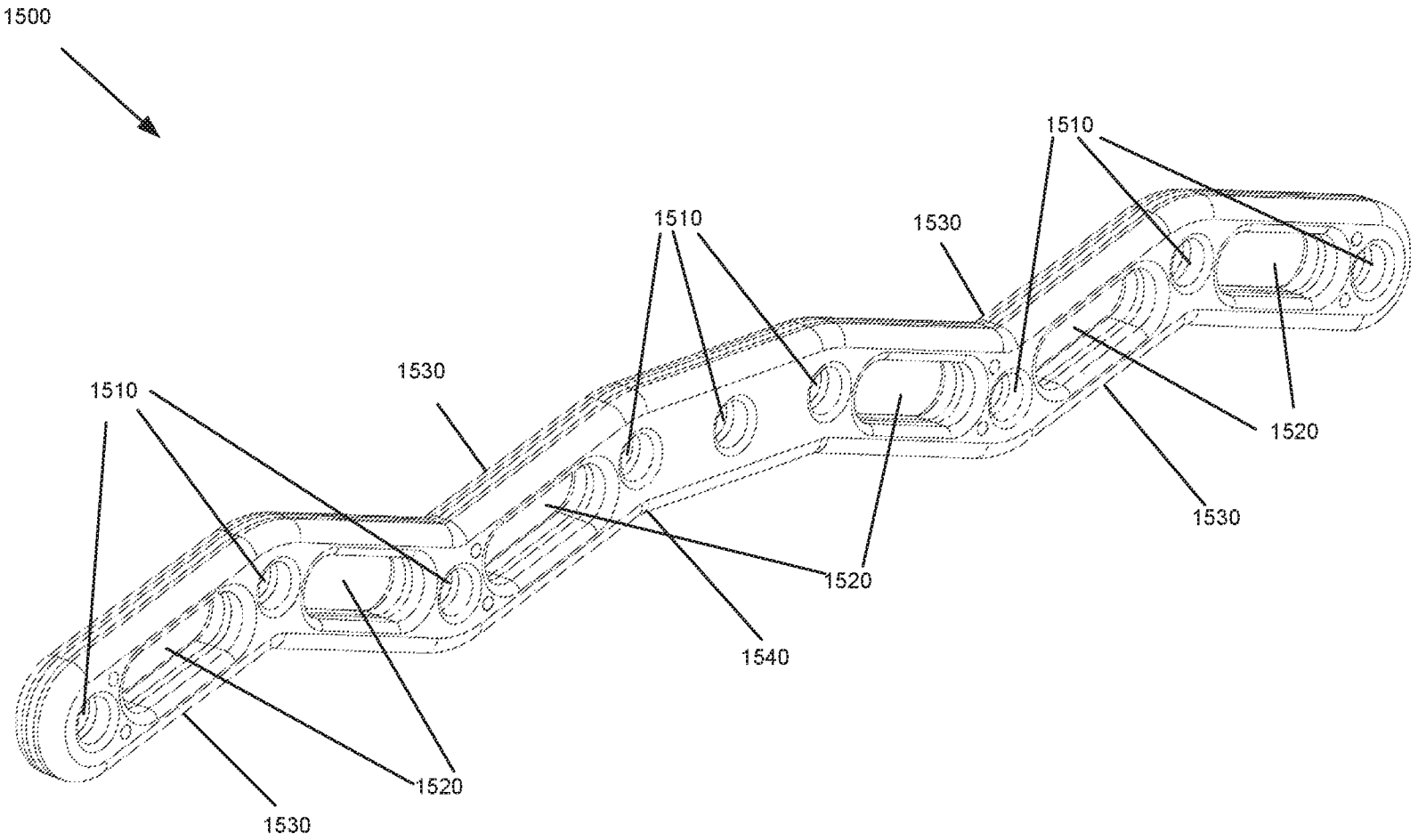
FIG. 45 is a perspective view of another workout device.

Other shapes of workout devices 100, 200, 300, and 400 are possible. In some embodiments, workout devices 100, 200, 300, and 400 may have a generally non-arced shape. FIG. 45 depicts a workout device 1500 with a shape defined by multiple linear segments where adjoining linear segments may not be parallel. Workout device 1500 may comprise a plurality of attachment points 1510, a plurality of handholds 1520, a plurality of support regions 1530, and a cradle 1540. Attachment points 1510 may be generally similar to attachment points 106 as described herein. Handholds 1520 may be positioned between attachment points 1510. Handholds 1520 may allow a user to hold or grip workout device 1500 with one or more hands and/or one or more fingers. As depicted, handholds 1520 may extend through workout device 1500, or handholds 1520 may not extend through workout device 1500. Support regions 1530 may allow a user to hold or secure workout device 1500 at a position other than handholds 1520. Cradle 1540 may be a recess in workout device 1500 that may create space for a user's upper back muscles and/or spine when workout device 1500 is laid across the upper back and/or shoulders of a user. As depicted in FIG. 45, attachment points 1510 and handholds 1520 may be internal to workout device 1500, and may not fall along a curved axis similar to axis 1130 as shown in FIG. 41 or axis 1240 as shown in FIG. 42.

Figure 46:
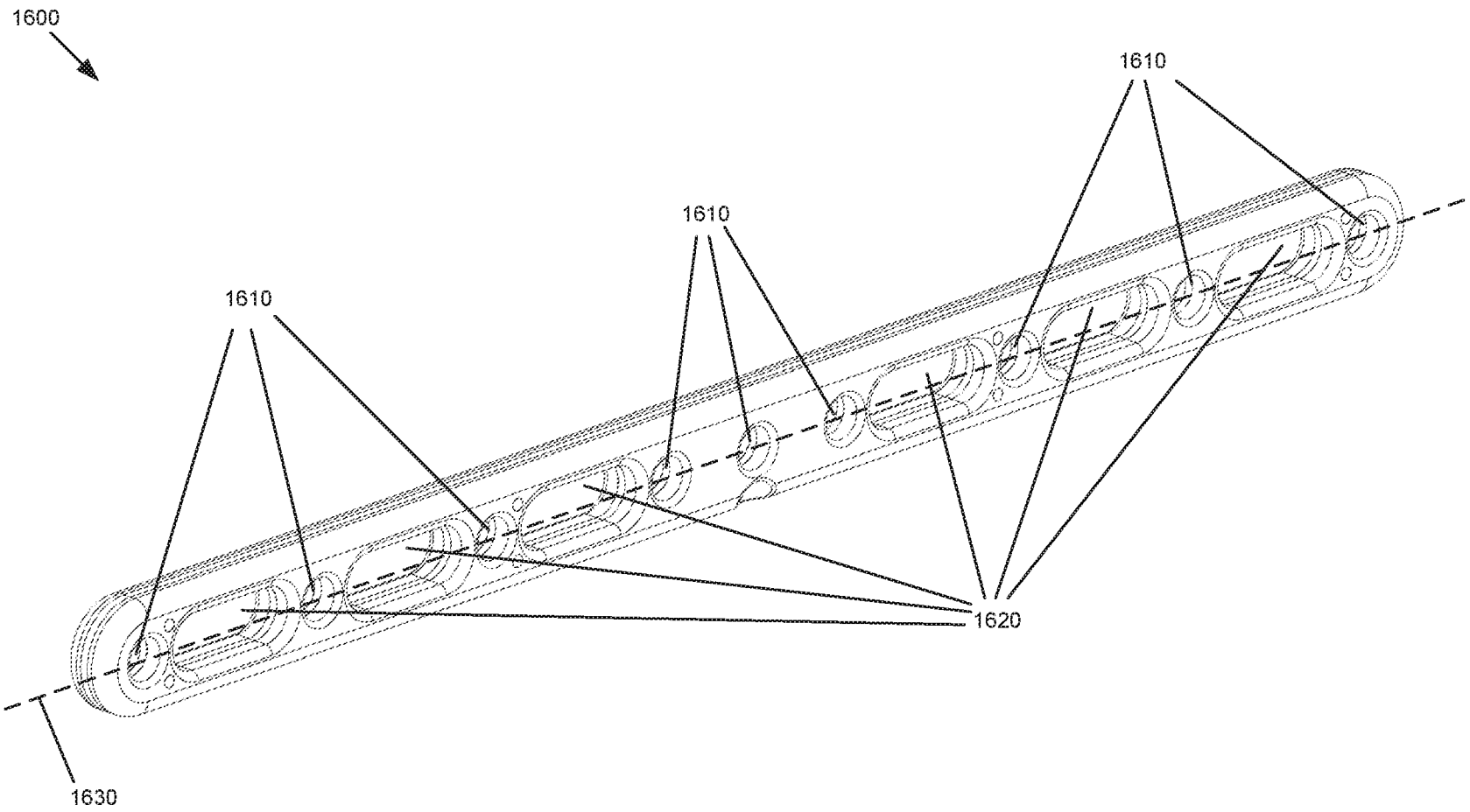
FIG. 46 is a perspective view of another workout device.

In other embodiments, workout devices 100, 200, 300, and 400 may have a generally straight shape. FIG. 46 depicts a workout device 1600 comprising a plurality of attachment points 1610 and a plurality of handholds 1620 along an axis 1630. Attachment points 1610 may be generally similar to attachment points 106 as described herein. Handholds 1620 may be positioned between attachment points 1610. Handholds 1620 may allow a user to hold or grip workout device

1600 with one or more hands and/or one or more fingers. As depicted, handholds 1620 may extend through workout device 1600, or handholds 1620 may not extend through workout device 1600. Axis 1630 may run along workout device 1600 and may be a generally straight line. Axis 1630 may intersect attachment points 1610 and handholds 1620. In some embodiments, axis 1630 may be the neutral axis of workout device 1600.

The preceding discussion provides many example embodiments. Although each embodiment represents a single combination of inventive elements, other examples may include all possible combinations of the disclosed elements. Thus if one embodiment comprises elements A, B, and C, and a second embodiment comprises elements B and D, other remaining combinations of A, B, C, or D, may also be used.

The term "connected" or "coupled to" may include both direct coupling (in which two elements that are coupled to each other contact each other) and indirect coupling (in which at least one additional element is located between the two elements).

Although the embodiments have been described in detail, it should be understood that various changes, substitutions and alterations can be made herein.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps As can be understood, the examples described above and illustrated are intended to be exemplary only. The invention is defined by the appended claims.

What is claimed is:

1. A workout device comprising:

an arcuate body having first and second ends, the body having an inner edge defining a cervical notch for receiving a cervical spine of a user;

one or more attachment points extending through the body, each attachment point for releasably attaching a load and for releasably attaching an anchor to suspend the workout device; and a centre attachment point positioned at a centre of the body, and at least one other attachment point positioned offset from the centre of the body.

2. The workout device of claim 1, wherein the inner edge defines a trapezius cradle for conforming to a trapezius of a user.

3. The workout device of claim 1, wherein said attachment points permit pivoting of the load attached thereto.

4. The workout device of claim 1, wherein said attachment points permit pivoting of the body when the anchor is attached thereto.

5. The workout device of claim 1, wherein said centre attachment point permits pivoting of the body when the anchor is attached thereto.

6. The workout device of claim 1, operable to be asymmetrically loaded about the centre of the body.

7. The workout device of claim 1, wherein the body comprises an internal support plate, a first external frame, and a second external frame, the internal support plate comprising a first side and a second side opposite the first side, the first external frame joined to the first side, and the second external frame joined to the second side.

8. The workout device of claim 7, wherein the internal support structure comprises an internal support plate having one or more plate attachment holes extending therethrough, and the first and second external frames comprise one or more frame attachment holes extending therethrough, the plate attachment holes and frame attachment holes defining the one or more attachment points when the internal support plate and the first and second external frames are joined.

9. The workout device of claim 7, wherein the internal support structure comprises a truss.

10. The workout device of claim 9, wherein one or more internal attachment sleeves are mounted to the truss, and the first and second external frames comprise one or more frame attachment holes extending therethrough, the internal attachment sleeves and frame attachment holes defining the one or more attachment points when the internal support structure and the first and second external frames are joined.

11. The workout device of claim 1, wherein the body further comprises one or more gripping surfaces for gripping onto the body.

12. The workout device of claim 11, wherein the one or more gripping surfaces are defined by an edge of the body, the one or more attachment points, a crimp hold, a hand grip, a two-finger pocket hold, or a three-finger pocket hold.

13. The workout device of claim 1, wherein the body is comprised of at least two detachable modular segments, wherein at least a first modular segment comprises the first end, and at least a second modular segment comprises the second end.

14. The workout device of claim 1, further comprising a sensor and a Bluetooth radio wave transmitter embedded in the body, the radio wave transmitter connected to the sensor, wherein the sensor is configured to generate signals based on an orientation and a dynamic state of the body, and wherein the radio wave transmitter is configured to receive the signals generated by the sensor, generate radio waves indicative of the orientation and the dynamic state of the body, and transmitting the radio waves.

* * * * *